US011391281B2

(12) United States Patent
Stiles, Jr. et al.

(10) Patent No.: US 11,391,281 B2
(45) Date of Patent: Jul. 19, 2022

(54) PRIMING PROTECTION

(71) Applicants: Pentair Water Pool and Spa, Inc., Cary, NC (US); Danfoss Power Electronics A/S, Graasten (DK)

(72) Inventors: Robert W. Stiles, Jr., Cary, NC (US); Lars Hoffmann Berthelsen, Kolding (DK); Gert Kjaer, Soenderborg (DK); Florin Lungeanu, Beijing (CN)

(73) Assignees: Pentair Water Pool and Spa, Inc., Cary, NC (US); Danfoss Power Electronics A/S, Graasten (DE)

( * ) Notice: Subject to any disclaimer, the term of this patent is extended or adjusted under 35 U.S.C. 154(b) by 36 days.

(21) Appl. No.: 16/984,588

(22) Filed: Aug. 4, 2020

(65) Prior Publication Data

US 2020/0362866 A1 Nov. 19, 2020

Related U.S. Application Data

(60) Division of application No. 14/877,817, filed on Oct. 7, 2015, now Pat. No. 10,731,655, which is a division
(Continued)

(51) Int. Cl.
*F04D 15/02* (2006.01)
*F04B 49/02* (2006.01)
(Continued)

(52) U.S. Cl.
CPC ..... *F04D 15/0245* (2013.01); *F04B 49/02* (2013.01); *F04D 9/02* (2013.01);
(Continued)

(58) Field of Classification Search
CPC ..... F04D 15/0245; F04D 15/0066; F04D 15/0077; F04D 15/0088; F04D 9/02;
(Continued)

(56) References Cited

U.S. PATENT DOCUMENTS 981,213 A 1/1911 Mollitor
1,061,919 A 5/1913 Miller
(Continued)

FOREIGN PATENT DOCUMENTS

AU 3940997 A 2/1998
AU 2005204246 A1 3/2006
(Continued)

OTHER PUBLICATIONS

U .S. Court of Appeals for the Federal Circuit, Notice of Entry of Judgment, accompanied by Opinion, in Case No. 2017-1021, Document 57-1, filed and entered Feb. 7, 2018, pp. 1-16.
(Continued)

*Primary Examiner* — Charles G Freay
(74) *Attorney, Agent, or Firm* — Husch Blackwell LLP

(57) ABSTRACT

Embodiments of the invention provide a pumping system for at least one aquatic application. The pumping system includes a pump, a motor coupled to the pump, and a controller in communication with the motor. The controller is configured to store a timeout time value. The controller is also configured to initiate a pump priming process and subsequently initiate a timeout counter to begin counting a counter time value. The controller is configured to initiate a timeout interrupt routine that interrupts the pump priming process when the counter time value exceeds the timeout time value. The timeout interrupt routine includes shutting down the motor.

17 Claims, 7 Drawing Sheets

Related U.S. Application Data of application No. 14/071,547, filed on Nov. 4, 2013, now abandoned, which is a division of application No. 13/220,537, filed on Aug. 29, 2011, now Pat. No. 8,573,952, which is a continuation of application No. 11/608,001, filed on Dec. 7, 2006, now Pat. No. 8,469,675, which is a continuation-in-part of application No. 11/286,888, filed on Nov. 23, 2005, now Pat. No. 8,019,479, which is a continuation-in-part of application No. 10/926,513, filed on Aug. 26, 2004, now Pat. No. 7,874,808.

(51) Int. Cl.

| | |
|---|---|
| ***F04D 13/06*** | (2006.01) |
| ***F04D 9/02*** | (2006.01) |
| ***F04D 15/00*** | (2006.01) |
| *F04B 49/20* | (2006.01) |
| *F04B 49/06* | (2006.01) |
| *F04D 1/00* | (2006.01) |

(52) U.S. Cl.

CPC ..... *F04D 13/06* (2013.01); *F04D 15/0066* (2013.01); *F04D 15/0077* (2013.01); *F04D 15/0088* (2013.01); *F04B 49/065* (2013.01); *F04B 49/20* (2013.01); *F04D 1/00* (2013.01)

(58) Field of Classification Search

CPC ..... F04D 13/06; F04B 49/02; F04B 49/065; F04B 49/20

See application file for complete search history.

(56) References Cited

U.S. PATENT DOCUMENTS

| | | | |
|---|---|---|---|
| 1,993,267 | A | 3/1935 | Ferguson |
| 2,238,597 | A | 4/1941 | Page |
| 2,458,006 | A | 1/1949 | Kilgore |
| 2,488,365 | A | 11/1949 | Abbott et al. |
| 2,494,200 | A | 1/1950 | Ramqvist |
| 2,615,937 | A | 10/1952 | Ludwig et al. |
| 2,716,195 | A | 8/1955 | Anderson |
| 2,767,277 | A | 10/1956 | Wirth |
| 2,778,958 | A | 1/1957 | Hamm et al. |
| 2,881,337 | A | 4/1959 | Wall |
| 3,116,445 | A | 12/1963 | Wright |
| 3,191,935 | A | 6/1965 | Uecker |
| 3,204,423 | A | 9/1965 | Resh, Jr. |
| 3,213,304 | A | 10/1965 | Landberg et al. |
| 3,226,620 | A | 12/1965 | Elliott et al. |
| 3,227,808 | A | 1/1966 | Morris et al. |
| 3,291,058 | A | 12/1966 | McFarlin |
| 3,316,843 | A | 5/1967 | Vaughan |
| 3,481,973 | A | 12/1969 | Arons et al. |
| 3,530,348 | A | 9/1970 | Conner |
| 3,558,910 | A | 1/1971 | Dale et al. |
| 3,559,731 | A | 2/1971 | Stafford |
| 3,562,614 | A | 2/1971 | Gramkow |
| 3,566,225 | A | 2/1971 | Poulsen |
| 3,573,579 | A | 4/1971 | Lewus |
| 3,581,895 | A | 6/1971 | Howard et al. |
| 3,593,081 | A | 7/1971 | Forst |
| 3,594,623 | A | 7/1971 | Lamaster |
| 3,596,158 | A | 7/1971 | Watrous |
| 3,613,805 | A | 10/1971 | Lindstad et al. |
| 3,624,470 | A | 11/1971 | Johnson |
| 3,634,842 | A | 1/1972 | Niedermeyer |
| 3,652,912 | A | 3/1972 | Bordonaro |
| 3,671,830 | A | 6/1972 | Kruper |
| 3,726,606 | A | 4/1973 | Peters |
| 3,735,233 | A | 5/1973 | Ringle |
| 3,737,749 | A | 6/1973 | Schmit |
| 3,753,072 | A | 8/1973 | Jurgens |
| 3,761,750 | A | 9/1973 | Green |
| 3,761,792 | A | 9/1973 | Whitney et al. |
| 3,777,232 | A | 12/1973 | Woods et al. |
| 3,777,804 | A | 12/1973 | McCoy |
| 3,778,804 | A | 12/1973 | Adair |
| 3,780,759 | A | 12/1973 | Yahle |
| 3,781,925 | A | 1/1974 | Curtis et al. |
| 3,787,882 | A | 1/1974 | West et al. |
| 3,792,324 | A | 2/1974 | Suarfz et al. |
| 3,800,205 | A | 3/1974 | Zalar |
| 3,814,544 | A | 6/1974 | Roberts et al. |
| 3,838,597 | A | 10/1974 | Montgomery et al. |
| 3,867,071 | A | 2/1975 | Hartley |
| 3,882,364 | A | 5/1975 | Wright |
| 3,902,369 | A | 9/1975 | Metz |
| 3,910,725 | A | 10/1975 | Rule |
| 3,913,342 | A | 10/1975 | Barry |
| 3,916,274 | A | 10/1975 | Lewus |
| 3,941,507 | A | 3/1976 | Niedermeyer |
| 3,949,782 | A | 4/1976 | Athey et al. |
| 3,953,777 | A | 4/1976 | McKee |
| 3,956,760 | A | 5/1976 | Edwards |
| 3,963,375 | A | 6/1976 | Curtis |
| 3,972,647 | A | 8/1976 | Niedermeyer |
| 3,976,919 | A | 8/1976 | Vandevier et al. |
| 3,987,240 | A | 10/1976 | Schultz |
| 4,000,446 | A | 12/1976 | Vandevier et al. |
| 4,021,700 | A | 5/1977 | Ellis-Anwyl |
| 4,030,450 | A | 6/1977 | Hoult |
| 4,041,470 | A | 8/1977 | Slane et al. |
| 4,061,442 | A | 12/1977 | Clark et al. |
| 4,087,204 | A | 5/1978 | Niedermeyer |
| 4,108,574 | A | 8/1978 | Bartley et al. |
| 4,123,792 | A | 10/1978 | Gephart et al. |
| 4,133,058 | A | 1/1979 | Baker |
| 4,142,415 | A | 3/1979 | Jung et al. |
| 4,151,080 | A | 4/1979 | Zuckerman et al. |
| 4,157,728 | A | 6/1979 | Mitamura et al. |
| 4,168,413 | A | 9/1979 | Halpine |
| 4,169,377 | A | 10/1979 | Scheib |
| 4,182,363 | A | 1/1980 | Fuller |
| 4,185,187 | A | 1/1980 | Rogers |
| 4,187,503 | A | 2/1980 | Walton |
| 4,206,634 | A | 6/1980 | Taylor et al. |
| 4,215,975 | A | 8/1980 | Niedermeyer |
| 4,222,711 | A | 9/1980 | Mayer |
| 4,225,290 | A | 9/1980 | Allington |
| 4,228,427 | A | 10/1980 | Niedermeyer |
| 4,233,553 | A | 11/1980 | Prince et al. |
| 4,241,299 | A | 12/1980 | Bertone |
| 4,255,747 | A | 3/1981 | Bunia |
| 4,263,535 | A | 4/1981 | Jones |
| 4,276,454 | A | 6/1981 | Zathan |
| 4,286,303 | A | 8/1981 | Genheimer et al. |
| 4,303,203 | A | 12/1981 | Avery |
| 4,307,327 | A | 12/1981 | Streater et al. |
| 4,309,157 | A | 1/1982 | Niedermeyer |
| 4,314,478 | A | 2/1982 | Beaman |
| 4,319,712 | A | 3/1982 | Bar |
| 4,322,297 | A | 3/1982 | Bajka |
| 4,330,412 | A | 5/1982 | Frederick |
| 4,332,527 | A | 6/1982 | Moldovan et al. |
| 4,353,220 | A | 10/1982 | Curwen et al. |
| 4,366,426 | A | 12/1982 | Turlej |
| 4,369,438 | A | 1/1983 | Wilhelmi |
| 4,370,098 | A | 1/1983 | McClain et al. |
| 4,370,690 | A | 1/1983 | Baker |
| 4,371,315 | A | 2/1983 | Shikasho |
| 4,375,613 | A | 3/1983 | Fuller et al. |
| 4,384,825 | A | 5/1983 | Thomas et al. |
| 4,394,262 | A | 7/1983 | Bukowski et al. |
| 4,399,394 | A | 8/1983 | Ballman |
| 4,402,094 | A | 9/1983 | Sanders |
| 4,409,532 | A | 10/1983 | Hollenbeck et al. |
| 4,419,625 | A | 12/1983 | Bejot et al. |
| 4,420,787 | A | 12/1983 | Tibbits et al. |
| 4,421,643 | A | 12/1983 | Frederick |
| 4,425,836 | A | 1/1984 | Pickrell |
| 4,427,545 | A | 1/1984 | Arguilez |
| 4,428,434 | A | 1/1984 | Gelaude |

(56) References Cited

U.S. PATENT DOCUMENTS 4,429,343 A 1/1984 Freud
4,437,133 A 3/1984 Rueckert
4,448,072 A 5/1984 Tward
4,449,260 A 5/1984 Whitaker
4,453,118 A 6/1984 Phillips et al.
4,456,432 A 6/1984 Mannino
4,462,758 A 7/1984 Speed
4,463,304 A 7/1984 Miller
4,468,604 A 8/1984 Zaderej
4,470,092 A 9/1984 Lombardi
4,473,338 A 9/1984 Garmong
4,494,180 A 1/1985 Streater et al.
4,496,895 A 1/1985 Kawate et al.
4,504,773 A 3/1985 Suzuki et al.
4,505,643 A 3/1985 Millis et al.
D278,529 S 4/1985 Hoogner
4,514,989 A 5/1985 Mount
4,520,303 A 5/1985 Ward
4,529,359 A 7/1985 Sloan
4,541,029 A 9/1985 Ohyama
4,545,906 A 10/1985 Frederick
4,552,512 A 11/1985 Gallup et al.
4,564,041 A 1/1986 Kramer
4,564,882 A 1/1986 Baxter et al.
4,581,900 A 4/1986 Lowe et al.
4,604,563 A 8/1986 Min
4,605,888 A 8/1986 Kim
4,610,605 A 9/1986 Hartley
4,620,835 A 11/1986 Bell
4,622,506 A 11/1986 Shemanske et al.
4,635,441 A 1/1987 Ebbing et al.
4,647,825 A 3/1987 Profio et al.
4,651,077 A 3/1987 Woyski
4,652,802 A 3/1987 Johnston
4,658,195 A 4/1987 Min
4,658,203 A 4/1987 Freymuth
4,668,902 A 5/1987 Zeller, Jr.
4,670,697 A 6/1987 Wrege et al.
4,676,914 A 6/1987 Mills et al.
4,678,404 A 7/1987 Lorett et al.
4,678,409 A 7/1987 Kurokawa
4,686,439 A 8/1987 Cunningham et al.
4,695,779 A 9/1987 Yates
4,697,464 A 10/1987 Martin
4,703,387 A 10/1987 Miller
4,705,629 A 11/1987 Weir et al.
4,716,605 A 1/1988 Shepherd et al.
4,719,399 A 1/1988 Wrege
4,728,882 A 3/1988 Stanbro et al.
4,751,449 A 6/1988 Chmiel
4,751,450 A 6/1988 Lorenz et al.
4,758,697 A 7/1988 Jeuneu
4,761,601 A 8/1988 Zaderej
4,764,417 A 8/1988 Gulya
4,764,714 A 8/1988 Alley et al.
4,766,329 A 8/1988 Santiago
4,767,280 A 8/1988 Markuson et al.
4,780,050 A 10/1988 Caine et al.
4,781,525 A 11/1988 Hubbard et al.
4,782,278 A 11/1988 Bossi et al.
4,786,850 A 11/1988 Chmiel
4,789,307 A 12/1988 Sloan
4,795,314 A 1/1989 Prybella et al.
4,801,858 A 1/1989 Min
4,804,901 A 2/1989 Pertessis et al.
4,806,457 A 2/1989 Yanagisawa
4,820,964 A 4/1989 Kadah et al.
4,827,197 A 5/1989 Giebeler
4,834,624 A 5/1989 Jensen et al.
4,837,656 A 6/1989 Barnes
4,839,571 A 6/1989 Farnham et al.
4,841,404 A 6/1989 Marshall et al.
4,843,295 A 6/1989 Thompson et al.
4,862,053 A 8/1989 Jordan et al.
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi et al.
4,958,118 A 9/1990 Pottebaum
4,963,778 A 10/1990 Jensen et al.
4,967,131 A 10/1990 Kim
4,971,522 A 11/1990 Butlin
4,975,798 A 12/1990 Edwards et al.
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,015,151 A * 5/1991 Snyder, Jr. ..... F04D 15/0254 417/18
5,015,152 A 5/1991 Greene
5,017,853 A 5/1991 Chmiel
5,026,256 A 6/1991 Kuwabara et al.
5,041,771 A 8/1991 Min
5,051,068 A 9/1991 Wong
5,051,681 A 9/1991 Schwarz
5,076,761 A 12/1991 Krohn et al.
5,076,763 A 12/1991 Anastos et al.
5,079,784 A 1/1992 Rist et al.
5,091,817 A 2/1992 Alley et al.
5,098,023 A 3/1992 Burke
5,099,181 A 3/1992 Canon
5,100,298 A 3/1992 Shibata et al.
RE33,874 E 4/1992 Miller
5,103,154 A 4/1992 Dropps et al.
5,117,233 A 5/1992 Hamos et al.
5,123,080 A 6/1992 Gillett et al.
5,129,264 A 7/1992 Lorenc
5,135,359 A 8/1992 Dufresne
5,145,323 A 9/1992 Farr
5,151,017 A 9/1992 Sears et al.
5,154,821 A 10/1992 Reid
5,156,535 A 10/1992 Budris et al.
5,158,436 A 10/1992 Jensen et al.
5,159,713 A 10/1992 Gaskill et al.
5,164,651 A 11/1992 Hu et al.
5,166,595 A 11/1992 Leverich
5,167,041 A 12/1992 Burkitt
5,172,089 A 12/1992 Wright et al.
D334,542 S 4/1993 Lowe et al.
5,206,573 A 4/1993 McCleer et al.
5,213,477 A 5/1993 Watanabe et al.
5,222,867 A 6/1993 Walker, Sr. et al.
5,234,286 A 8/1993 Wagner
5,234,319 A 8/1993 Wilder
5,235,235 A 8/1993 Martin et al.
5,238,369 A 8/1993 Farr
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier et al.
5,295,790 A 3/1994 Bossart et al.
5,295,857 A 3/1994 Toly
5,296,795 A 3/1994 Dropps et al.
5,302,885 A 4/1994 Schwarz et al.
5,319,298 A 6/1994 Wanzong et al.
5,324,170 A 6/1994 Anastos et al.
5,327,036 A 7/1994 Carey
5,342,176 A 8/1994 Redlich
5,347,664 A 9/1994 Hamza et al.
5,349,281 A 9/1994 Bugaj
5,351,709 A 10/1994 Vos
5,351,714 A 10/1994 Barnowski
5,352,969 A 10/1994 Gilmore et al.
5,360,320 A 11/1994 Jameson et al.
5,361,215 A 11/1994 Tompkins et al.
5,363,912 A 11/1994 Wolcott
5,394,748 A 3/1995 McCarthy

(56) References Cited

U.S. PATENT DOCUMENTS 5,418,984 A 5/1995 Livingston, Jr.
D359,458 S 6/1995 Pierret et al.
5,422,014 A 6/1995 Allen et al.
5,423,214 A 6/1995 Lee
5,425,624 A 6/1995 Williams
5,443,368 A 8/1995 Weeks et al.
5,444,354 A 8/1995 Takahashi et al.
5,449,274 A 9/1995 Kochan
5,449,997 A 9/1995 Gilmore et al.
5,450,316 A 9/1995 Gaudet et al.
D363,060 S 10/1995 Hunger et al.
5,457,373 A 10/1995 Heppe et al.
5,457,826 A 10/1995 Haraga et al.
5,466,995 A 11/1995 Genga
5,469,215 A 11/1995 Nashiki
5,471,125 A 11/1995 Wu
5,473,497 A 12/1995 Beatty
5,483,229 A 1/1996 Tamura et al.
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein et al.
5,519,848 A 5/1996 Wloka et al.
5,520,517 A 5/1996 Sipin
5,522,707 A 6/1996 Potter
5,528,120 A 6/1996 Brodetsky
5,529,462 A 6/1996 Hawes
5,532,635 A 7/1996 Watrous et al.
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill et al.
5,550,497 A 8/1996 Carobolante
5,550,753 A 8/1996 Tompkins et al.
5,559,418 A 9/1996 Burkhart
5,559,720 A 9/1996 Tompkins et al.
5,559,762 A 9/1996 Sakamoto
5,561,357 A 10/1996 Schroeder
5,562,422 A 10/1996 Ganzon et al.
5,563,759 A 10/1996 Nadd
D375,908 S 11/1996 Schumaker et al.
5,570,481 A 11/1996 Mathis et al.
5,571,000 A 11/1996 Zimmermann et al.
5,577,890 A 11/1996 Nielsen et al.
5,580,221 A 12/1996 Triezenberg
5,582,017 A 12/1996 Noji et al.
5,587,899 A 12/1996 Ho et al.
5,589,076 A 12/1996 Womack
5,589,753 A 12/1996 Kadah et al.
5,592,062 A 1/1997 Bach
5,598,080 A 1/1997 Jensen et al.
5,601,413 A 2/1997 Langley et al.
5,604,491 A 2/1997 Coonley et al.
5,614,812 A 3/1997 Wagoner
5,616,239 A 4/1997 Wendell et al.
5,618,460 A 4/1997 Fowler et al.
5,622,223 A 4/1997 Vasquez
5,624,237 A 4/1997 Prescott et al.
5,626,464 A 5/1997 Schoenmeyr et al.
5,628,896 A 5/1997 Klingenberger
5,629,601 A 5/1997 Feldstein
5,632,468 A 5/1997 Schoenmeyr
5,633,540 A 5/1997 Moan
5,640,078 A 6/1997 Kou et al.
5,654,504 A 8/1997 Smith et al.
5,654,620 A 8/1997 Langhorst
5,669,323 A 9/1997 Pritchard
5,672,050 A 9/1997 Webber et al.
5,682,624 A 11/1997 Ciochetti
5,690,476 A 11/1997 Miller
5,708,337 A 1/1998 Breit et al.
5,708,348 A 1/1998 Frey et al.
5,711,483 A 1/1998 Hays
5,712,795 A 1/1998 Layman et al.
5,713,320 A 2/1998 Pfaff et al.
5,727,933 A 3/1998 Laskaris et al.
5,730,861 A 3/1998 Sterghos et al.
5,731,673 A 3/1998 Gilmore
5,736,884 A 4/1998 Ettes et al.
5,739,648 A 4/1998 Ellis et al.
5,744,921 A 4/1998 Makaran
5,752,785 A 5/1998 Tanaka et al.
5,754,036 A 5/1998 Walker
5,754,421 A 5/1998 Nystrom
5,763,969 A 6/1998 Metheny et al.
5,767,606 A 6/1998 Bresolin
5,777,833 A 7/1998 Romillon
5,780,992 A 7/1998 Beard
5,791,882 A 8/1998 Stucker et al.
5,796,234 A 8/1998 Vrionis
5,802,910 A 9/1998 Krahn et al.
5,804,080 A 9/1998 Klingenberger
5,808,441 A 9/1998 Nehring
5,814,966 A 9/1998 Williamson et al.
5,818,708 A 10/1998 Wong
5,818,714 A 10/1998 Zou et al.
5,819,848 A 10/1998 Rasmuson et al.
5,820,350 A 10/1998 Mantey et al.
5,828,200 A 10/1998 Ligman et al.
5,833,437 A 11/1998 Kurth et al.
5,836,271 A 11/1998 Sasaki et al.
5,845,225 A 12/1998 Mosher
5,856,783 A 1/1999 Gibb
5,863,185 A 1/1999 Cochimin et al.
5,883,489 A 3/1999 Konrad
5,884,205 A 3/1999 Elmore et al.
5,892,349 A 4/1999 Bogwicz et al.
5,894,609 A 4/1999 Barnett
5,898,958 A 5/1999 Hall
5,906,479 A 5/1999 Hawes
5,907,281 A 5/1999 Miller et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,944,444 A 8/1999 Motz et al.
5,945,802 A 8/1999 Konrad et al.
5,946,469 A 8/1999 Chidester
5,947,689 A 9/1999 Schick
5,947,700 A 9/1999 McKain et al.
5,959,431 A 9/1999 Youqing
5,959,534 A 9/1999 Campbell et al.
5,961,291 A 10/1999 Sakagami et al.
5,963,706 A 10/1999 Baik
5,969,958 A 10/1999 Nielsen et al.
5,973,465 A 10/1999 Rayner
5,973,473 A 10/1999 Anderson et al.
5,977,732 A 11/1999 Matsumoto
5,983,146 A 11/1999 Sarbach
5,986,433 A 11/1999 Peele et al.
5,987,105 A 11/1999 Jenkins et al.
5,991,939 A 11/1999 Mulvey
6,030,180 A 2/2000 Clarey et al.
6,037,742 A 3/2000 Rasmussen
6,043,461 A 3/2000 Holling et al.
6,045,331 A 4/2000 Gehm et al.
6,045,333 A 4/2000 Breit
6,046,492 A 4/2000 Machida et al.
6,048,183 A 4/2000 Meza
6,056,008 A 5/2000 Adams et al.
6,059,536 A 5/2000 Stingl
6,065,946 A 5/2000 Lathrop
6,072,291 A 6/2000 Pedersen
6,080,973 A 6/2000 Thweatt
6,081,751 A 6/2000 Luo et al.
6,091,604 A 7/2000 Plougsgaard et al.
6,092,992 A 7/2000 Imblum et al.
D429,699 S 8/2000 Davis et al.
D429,700 S 8/2000 Liebig

(56) References Cited

U.S. PATENT DOCUMENTS

| | | | |
|---|---|---|---|
| 6,094,764 | A | 8/2000 | Veloskey et al. |
| 6,098,654 | A | 8/2000 | Cohen et al. |
| 6,102,665 | A | 8/2000 | Centers et al. |
| 6,110,322 | A | 8/2000 | Teoh et al. |
| 6,116,040 | A | 9/2000 | Stark |
| 6,119,707 | A | 9/2000 | Jordan |
| 6,121,746 | A | 9/2000 | Fisher et al. |
| 6,121,749 | A | 9/2000 | Wills et al. |
| 6,125,481 | A | 10/2000 | Sicilano |
| 6,125,883 | A | 10/2000 | Creps et al. |
| 6,142,741 | A | 11/2000 | Nishihata et al. |
| 6,146,108 | A | 11/2000 | Mullendore |
| 6,150,776 | A | 11/2000 | Potter et al. |
| 6,157,304 | A | 12/2000 | Bennett et al. |
| 6,164,132 | A | 12/2000 | Matulek |
| 6,171,073 | B1 | 1/2001 | McKain et al. |
| 6,178,393 | B1 | 1/2001 | Irvin |
| 6,184,650 | B1 | 2/2001 | Gelbman |
| 6,188,200 | B1 | 2/2001 | Maiorano |
| 6,198,257 | B1 | 3/2001 | Belehradek et al. |
| 6,199,224 | B1 | 3/2001 | Versland |
| 6,203,282 | B1 | 3/2001 | Morin |
| 6,208,112 | B1 | 3/2001 | Jensen et al. |
| 6,212,956 | B1 | 4/2001 | Donald et al. |
| 6,213,724 | B1 | 4/2001 | Haugen et al. |
| 6,216,814 | B1 | 4/2001 | Fujita et al. |
| 6,222,355 | B1 | 4/2001 | Ohshima et al. |
| 6,227,808 | B1 | 5/2001 | McDonough |
| 6,232,742 | B1 | 5/2001 | Wacknov et al. |
| 6,236,177 | B1 | 5/2001 | Zick et al. |
| 6,238,188 | B1 | 5/2001 | Lifson |
| 6,247,429 | B1 | 6/2001 | Hara et al. |
| 6,249,435 | B1 | 6/2001 | Vicente et al. |
| 6,251,285 | B1 | 6/2001 | Ciochetti |
| 6,253,227 | B1 | 6/2001 | Tompkins et al. |
| D445,405 | S | 7/2001 | Schneider et al. |
| 6,254,353 | B1 | 7/2001 | Polo et al. |
| 6,257,304 | B1 | 7/2001 | Jacobs et al. |
| 6,257,833 | B1 | 7/2001 | Bates |
| 6,259,617 | B1 | 7/2001 | Wu |
| 6,264,431 | B1 | 7/2001 | Triezenberg |
| 6,264,432 | B1 | 7/2001 | Kilayko et al. |
| 6,280,611 | B1 | 8/2001 | Henkin et al. |
| 6,282,370 | B1 | 8/2001 | Cline et al. |
| 6,298,721 | B1 | 10/2001 | Schuppe et al. |
| 6,299,414 | B1 | 10/2001 | Schoenmeyr |
| 6,299,699 | B1 | 10/2001 | Porat et al. |
| 6,318,093 | B2 | 11/2001 | Gaudet et al. |
| 6,320,348 | B1 | 11/2001 | Kadah |
| 6,326,752 | B1 | 12/2001 | Jensen et al. |
| 6,329,784 | B1 | 12/2001 | Puppin et al. |
| 6,330,525 | B1 | 12/2001 | Hays et al. |
| 6,342,841 | B1 | 1/2002 | Stingl |
| 6,349,268 | B1 | 2/2002 | Ketonen et al. |
| 6,350,105 | B1 | 2/2002 | Kobayashi et al. |
| 6,351,359 | B1 | 2/2002 | Jaeger |
| 6,354,805 | B1 | 3/2002 | Müller |
| 6,355,177 | B2 | 3/2002 | Senner et al. |
| 6,356,464 | B1 | 3/2002 | Balakrishnan et al. |
| 6,356,853 | B1 | 3/2002 | Sullivan |
| 6,362,591 | B1 | 3/2002 | Moberg |
| 6,364,620 | B1 | 4/2002 | Fletcher et al. |
| 6,364,621 | B1 | 4/2002 | Yamauchi |
| 6,366,053 | B1 | 4/2002 | Belehradek |
| 6,366,481 | B1 | 4/2002 | Balakrishnan et al. |
| 6,369,463 | B1 | 4/2002 | Maiorano |
| 6,373,204 | B1 | 4/2002 | Peterson et al. |
| 6,373,728 | B1 | 4/2002 | Aarestrup |
| 6,374,854 | B1 | 4/2002 | Acosta |
| 6,375,430 | B1 | 4/2002 | Eckert et al. |
| 6,380,707 | B1 | 4/2002 | Rosholm et al. |
| 6,388,642 | B1 | 5/2002 | Cotis |
| 6,390,781 | B1 | 5/2002 | McDonough |
| 6,406,265 | B1 | 6/2002 | Hahn et al. |
| 6,407,469 | B1 | 6/2002 | Cline et al. |
| 6,411,481 | B1 | 6/2002 | Seubert |
| 6,415,808 | B2 | 7/2002 | Joshi |
| 6,416,295 | B1 | 7/2002 | Nagai et al. |
| 6,426,633 | B1 | 7/2002 | Thybo |
| 6,443,715 | B1 | 9/2002 | Mayleben et al. |
| 6,445,565 | B1 | 9/2002 | Toyoda et al. |
| 6,447,446 | B1 | 9/2002 | Smith et al. |
| 6,448,713 | B1 | 9/2002 | Farkas et al. |
| 6,450,771 | B1 | 9/2002 | Centers et al. |
| 6,462,971 | B1 | 10/2002 | Balakrishnan et al. |
| 6,464,464 | B2 | 10/2002 | Sabini et al. |
| 6,468,042 | B2 | 10/2002 | Møller |
| 6,468,052 | B2 | 10/2002 | McKain et al. |
| 6,474,949 | B1 | 11/2002 | Arai et al. |
| 6,475,180 | B2 | 11/2002 | Peterson et al. |
| 6,481,973 | B1 | 11/2002 | Struthers |
| 6,483,278 | B2 | 11/2002 | Harvest |
| 6,483,378 | B2 | 11/2002 | Blodgett |
| 6,490,920 | B1 | 12/2002 | Netzer |
| 6,493,227 | B2 | 12/2002 | Nielsen et al. |
| 6,496,392 | B2 | 12/2002 | Odell |
| 6,499,961 | B1 | 12/2002 | Wyatt et al. |
| 6,501,629 | B1 | 12/2002 | Marriott |
| 6,503,063 | B1 | 1/2003 | Brunsell |
| 6,504,338 | B1 | 1/2003 | Eichorn |
| 6,520,010 | B1 | 2/2003 | Bergveld et al. |
| 6,522,034 | B1 | 2/2003 | Nakayama |
| 6,523,091 | B2 | 2/2003 | Tirumala et al. |
| 6,527,518 | B2 | 3/2003 | Ostrowski |
| 6,534,940 | B2 | 3/2003 | Bell et al. |
| 6,534,947 | B2 | 3/2003 | Johnson et al. |
| 6,537,032 | B1 | 3/2003 | Horiuchi et al. |
| 6,538,908 | B2 | 3/2003 | Balakrishnan et al. |
| 6,539,797 | B2 | 4/2003 | Livingston et al. |
| 6,543,940 | B2 | 4/2003 | Chu |
| 6,548,976 | B2 | 4/2003 | Jensen et al. |
| 6,564,627 | B1 | 5/2003 | Sabini et al. |
| 6,570,778 | B2 | 5/2003 | Lipo et al. |
| 6,571,807 | B2 | 6/2003 | Jones |
| 6,590,188 | B2 | 7/2003 | Cline et al. |
| 6,591,697 | B2 | 7/2003 | Henyan |
| 6,591,863 | B2 | 7/2003 | Ruschell et al. |
| 6,595,051 | B1 | 7/2003 | Chandler |
| 6,595,762 | B2 | 7/2003 | Khanwilkar et al. |
| 6,604,909 | B2 | 8/2003 | Schoenmeyr |
| 6,607,360 | B2 | 8/2003 | Fong |
| 6,616,413 | B2 | 9/2003 | Humpheries |
| 6,623,245 | B2 | 9/2003 | Meza et al. |
| 6,625,824 | B1 | 9/2003 | Lutz et al. |
| 6,626,840 | B2 | 9/2003 | Drzewiecki et al. |
| 6,628,501 | B2 | 9/2003 | Toyoda |
| 6,632,072 | B2 | 10/2003 | Lipscomb et al. |
| 6,636,135 | B1 | 10/2003 | Vetter |
| 6,638,023 | B2 | 10/2003 | Scott |
| D482,664 | S | 11/2003 | Hunt et al. |
| 6,643,153 | B2 | 11/2003 | Balakrishnan et al. |
| 6,651,900 | B1 | 11/2003 | Yoshida |
| 6,655,922 | B1 | 12/2003 | Flek |
| 6,663,349 | B1 | 12/2003 | Discenzo et al. |
| 6,665,200 | B2 | 12/2003 | Goto et al. |
| 6,672,147 | B1 | 1/2004 | Mazet |
| 6,675,912 | B2 | 1/2004 | Carrier |
| 6,676,382 | B2 | 1/2004 | Leighton et al. |
| 6,676,831 | B2 | 1/2004 | Wolfe |
| 6,687,141 | B2 | 2/2004 | Odell |
| 6,687,923 | B2 | 2/2004 | Dick et al. |
| 6,690,250 | B2 | 2/2004 | Møller |
| 6,696,676 | B1 | 2/2004 | Graves et al. |
| 6,700,333 | B1 | 3/2004 | Hirshi et al. |
| 6,709,240 | B1 | 3/2004 | Schmalz et al. |
| 6,709,241 | B2 | 3/2004 | Sabini et al. |
| 6,709,575 | B1 | 3/2004 | Verdegan et al. |
| 6,715,996 | B2 | 4/2004 | Moeller |
| 6,717,318 | B1 | 4/2004 | Mathiassen |
| 6,732,387 | B1 | 5/2004 | Waldron |
| 6,737,905 | B1 | 5/2004 | Noda et al. |
| D490,726 | S | 6/2004 | Eungprabhanth et al. |
| 6,742,387 | B2 | 6/2004 | Hamamoto et al. |
| 6,747,367 | B2 | 6/2004 | Cline et al. |

(56) References Cited

U.S. PATENT DOCUMENTS 6,761,067 B1 7/2004 Capano
6,768,279 B1 7/2004 Skinner et al.
6,770,043 B1 8/2004 Kahn
6,774,664 B2 8/2004 Godbersen
6,776,038 B1 8/2004 Horton et al.
6,776,584 B2 8/2004 Sabini et al.
6,778,868 B2 8/2004 Imamura et al.
6,779,205 B2 8/2004 Mulvey et al.
6,779,950 B1 8/2004 Hutchins
6,782,309 B2 8/2004 Laflamme et al.
6,783,328 B2 8/2004 Lucke et al.
6,789,024 B1 9/2004 Kochan et al.
6,794,921 B2 9/2004 Abe et al.
6,797,164 B2 9/2004 Leaverton
6,798,271 B2 9/2004 Swize
6,806,677 B2 10/2004 Kelly et al.
6,837,688 B2 1/2005 Kimberlin et al.
6,842,117 B2 1/2005 Keown
6,847,130 B1 1/2005 Belehradek et al.
6,847,854 B2 1/2005 Discenzo
6,854,479 B2 2/2005 Harwood
6,863,502 B2 3/2005 Bishop et al.
6,867,383 B1 3/2005 Currier
6,875,961 B1 4/2005 Collins
6,882,165 B2 4/2005 Ogura
6,884,022 B2 4/2005 Albright et al.
D504,900 S 5/2005 Wang
D505,429 S 5/2005 Wang
6,888,537 B2 5/2005 Benson et al.
6,895,608 B2 5/2005 Goettl
6,900,736 B2 5/2005 Crumb
6,906,482 B2 6/2005 Shimizu et al.
D507,243 S 7/2005 Miller
6,914,793 B2 7/2005 Balakrishnan et al.
6,922,348 B2 7/2005 Nakajima et al.
6,925,823 B2 8/2005 Lifson et al.
6,933,693 B2 8/2005 Schuchmann
6,941,785 B2 9/2005 Haynes et al.
6,943,325 B2 9/2005 Pittman et al.
D511,530 S 11/2005 Wang
D512,026 S 11/2005 Nurmi et al.
6,965,815 B1 11/2005 Tompkins et al.
6,966,967 B2 11/2005 Curry et al.
D512,440 S 12/2005 Wang
6,973,794 B2 12/2005 Street et al.
6,973,974 B2 12/2005 McLoughlin et al.
6,976,052 B2 12/2005 Tompkins et al.
D513,737 S 1/2006 Riley
6,981,399 B1 1/2006 Nybo et al.
6,981,402 B2 1/2006 Bristol
6,984,158 B2 1/2006 Satoh et al.
6,989,649 B2 1/2006 Mehlhorn
6,993,414 B2 1/2006 Shah
6,998,807 B2 2/2006 Phillips et al.
6,998,977 B2 2/2006 Gregori et al.
7,005,818 B2 2/2006 Jensen
7,012,394 B2 3/2006 Moore et al.
7,015,599 B2 3/2006 Gull et al.
7,040,107 B2 5/2006 Lee et al.
7,042,192 B2 5/2006 Mehlhorn
7,050,278 B2 5/2006 Poulsen
7,055,189 B2 6/2006 Goettl
7,070,134 B1 7/2006 Hoyer
7,077,781 B2 7/2006 Ishikawa et al.
7,080,508 B2 7/2006 Stavale et al.
7,081,728 B2 7/2006 Kemp
7,083,392 B2 8/2006 Meza et al.
7,083,438 B2 8/2006 Massaro et al.
7,089,607 B2 8/2006 Barnes et al.
7,100,632 B2 9/2006 Harwood
7,102,505 B2 9/2006 Kates
7,107,184 B2 9/2006 Gentile et al.
7,112,037 B2 9/2006 Sabini et al.
7,114,926 B2 10/2006 Oshita et al.
7,117,120 B2 10/2006 Beck et al.
7,141,210 B2 11/2006 Bell et al.
7,142,932 B2 11/2006 Spira et al.
D533,512 S 12/2006 Nakashima et al.
7,163,380 B2 1/2007 Jones
7,172,366 B1 2/2007 Bishop, Jr.
7,174,273 B2 2/2007 Goldberg
7,178,179 B2 2/2007 Barnes
7,183,741 B2 2/2007 Mehlhorn
7,195,462 B2 3/2007 Nybo et al.
7,201,563 B2 4/2007 Studebaker
7,221,121 B2 5/2007 Skaug et al.
7,244,106 B2 7/2007 Kallman et al.
7,245,105 B2 7/2007 Joo et al.
7,259,533 B2 8/2007 Yang et al.
7,264,449 B1 9/2007 Harned et al.
7,281,958 B2 10/2007 Schlittler et al.
7,292,898 B2 11/2007 Clark et al.
7,307,538 B2 12/2007 Kochan, Jr.
7,309,216 B1 12/2007 Spadola, Jr. et al.
7,318,344 B2 1/2008 Heger
D562,349 S 2/2008 Bulter
7,327,275 B2 2/2008 Brochu et al.
7,339,126 B1 3/2008 Niedermeyer
D567,189 S 4/2008 Stiles, Jr. et al.
7,352,550 B2 4/2008 Mladenik et al.
7,375,940 B1 5/2008 Bertrand
7,388,348 B2 6/2008 Mattichak
7,407,371 B2 8/2008 Leone et al.
7,427,844 B2 9/2008 Mehlhorn
7,429,842 B2 9/2008 Schulman et al.
7,437,215 B2 10/2008 Anderson et al.
D582,797 S 12/2008 Fraser et al.
D583,828 S 12/2008 Li et al.
7,458,782 B1 12/2008 Spadola, Jr. et al.
7,459,886 B1 12/2008 Potanin et al.
7,484,938 B2 2/2009 Allen
7,516,106 B2 4/2009 Ehlers et al.
7,517,351 B2 4/2009 Culp et al.
7,525,280 B2 4/2009 Fagan et al.
7,528,579 B2 5/2009 Pacholok et al.
7,542,251 B2 6/2009 Ivankovic
7,542,252 B2 6/2009 Chan et al.
7,572,108 B2 8/2009 Koehl
7,612,510 B2 11/2009 Koehl
7,612,529 B2 11/2009 Kochan, Jr.
7,623,986 B2 11/2009 Miller
7,641,449 B2 1/2010 Iimura et al.
7,652,441 B2 1/2010 Ying Yin Ho
7,686,587 B2 3/2010 Koehl
7,686,589 B2 3/2010 Stiles, Jr. et al.
7,690,897 B2 4/2010 Branecky et al.
7,700,887 B2 4/2010 Niedermeyer
7,704,051 B2 4/2010 Koehl
7,707,125 B2 4/2010 Haji-Valizadeh
7,727,181 B2 6/2010 Rush
7,739,733 B2 6/2010 Szydlo
7,746,063 B2 6/2010 Sabini et al.
7,751,159 B2 7/2010 Koehl
7,753,880 B2 7/2010 Malackowski
7,755,318 B1 7/2010 Panosh
7,775,327 B2 8/2010 Abraham et al.
7,777,435 B2 8/2010 Aguilar et al.
7,788,877 B2 9/2010 Andras
7,795,824 B2 9/2010 Shen et al.
7,808,211 B2 10/2010 Pacholok et al.
7,815,420 B2 10/2010 Koehl
7,821,215 B2 10/2010 Koehl
7,845,913 B2 12/2010 Stiles, Jr. et al.
7,854,597 B2 12/2010 Stiles, Jr. et al.
7,857,600 B2 12/2010 Koehl
7,874,808 B2 * 1/2011 Stiles ..... F04D 15/0209 417/18
7,878,766 B2 2/2011 Meza et al.
7,900,308 B2 3/2011 Erlich et al.
7,925,385 B2 4/2011 Stavale et al.
7,931,447 B2 4/2011 Levin et al.
7,945,411 B2 5/2011 Kernan et al.
7,976,284 B2 7/2011 Koehl
7,983,877 B2 7/2011 Koehl

(56) References Cited

U.S. PATENT DOCUMENTS 7,990,091 B2 8/2011 Koehl
8,007,255 B2 8/2011 Hattori et al.
8,011,895 B2 9/2011 Ruffo
8,019,479 B2 * 9/2011 Stiles ..... F04D 15/0066 700/282
8,032,256 B1 10/2011 Wolf et al.
8,043,070 B2 10/2011 Stiles, Jr. et al.
8,049,464 B2 11/2011 Muntermann
8,098,048 B2 1/2012 Hoff
8,104,110 B2 1/2012 Caudill et al.
8,126,574 B2 2/2012 Discenzo et al.
8,133,034 B2 3/2012 Mehlhorn et al.
8,134,336 B2 3/2012 Michalske et al.
8,164,470 B2 4/2012 Brochu et al.
8,177,520 B2 5/2012 Mehlhorn et al.
8,281,425 B2 10/2012 Cohen
8,299,662 B2 10/2012 Schmidt et al.
8,303,260 B2 11/2012 Stavale et al.
8,313,306 B2 11/2012 Stiles, Jr. et al.
8,316,152 B2 11/2012 Geltner et al.
8,317,485 B2 11/2012 Meza et al.
8,337,166 B2 12/2012 Meza et al.
8,380,355 B2 2/2013 Mayleben et al.
8,405,346 B2 3/2013 Trigiani
8,405,361 B2 3/2013 Richards et al.
8,444,394 B2 5/2013 Koehl
8,465,262 B2 6/2013 Stiles, Jr. et al.
8,469,675 B2 * 6/2013 Stiles, Jr. ..... F04D 15/0077 417/44.11
8,480,373 B2 7/2013 Stiles, Jr. et al.
8,500,413 B2 8/2013 Stiles, Jr. et al.
8,540,493 B2 9/2013 Koehl
8,547,065 B2 10/2013 Trigiani
8,573,952 B2 * 11/2013 Stiles, Jr. ..... F04B 49/20 417/12
8,579,600 B2 11/2013 Vijayakumar
8,602,745 B2 12/2013 Stiles, Jr. et al.
8,641,383 B2 2/2014 Meza et al.
8,641,385 B2 2/2014 Koehl
8,669,494 B2 3/2014 Tran
8,756,991 B2 6/2014 Edwards
8,763,315 B2 7/2014 Hartman et al.
8,774,972 B2 7/2014 Rusnak et al.
8,981,684 B2 3/2015 Drye et al.
9,030,066 B2 5/2015 Drye
9,051,930 B2 6/2015 Stiles, Jr. et al.
9,238,918 B2 1/2016 Mckinzie
9,328,727 B2 5/2016 Koehl
9,822,782 B2 11/2017 McKinzie
10,731,655 B2 * 8/2020 Stiles, Jr. ..... F04D 1/00
2001/0002238 A1 5/2001 McKain et al.
2001/0029407 A1 10/2001 Tompkins et al.
2001/0041139 A1 11/2001 Sabini et al.
2002/0000789 A1 1/2002 Haba
2002/0002989 A1 1/2002 Jones
2002/0010839 A1 1/2002 Mala et al.
2002/0018721 A1 2/2002 Kobayashi et al.
2002/0032491 A1 3/2002 Imamura et al.
2002/0035403 A1 3/2002 Clark et al.
2002/0050490 A1 5/2002 Pittman et al.
2002/0070611 A1 6/2002 Cline et al.
2002/0070875 A1 6/2002 Crumb
2002/0076330 A1 6/2002 Lipscomb et al.
2002/0082727 A1 6/2002 Laflamme et al.
2002/0089236 A1 7/2002 Cline et al.
2002/0093306 A1 7/2002 Johnson et al.
2002/0101193 A1 8/2002 Farkas et al.
2002/0111554 A1 8/2002 Drzewiecki et al.
2002/0131866 A1 9/2002 Phillips
2002/0136642 A1 9/2002 Moller
2002/0143478 A1 10/2002 Vanderah et al.
2002/0150476 A1 10/2002 Lucke et al.
2002/0163821 A1 11/2002 Odell
2002/0172055 A1 11/2002 Balakrishnan et al.
2002/0176783 A1 11/2002 Moeller
2002/0190687 A1 12/2002 Bell et al.
2003/0000303 A1 1/2003 Livingston et al.
2003/0017055 A1 1/2003 Fong
2003/0030954 A1 2/2003 Bax et al.
2003/0034284 A1 2/2003 Wolfe
2003/0034761 A1 2/2003 Goto et al.
2003/0048646 A1 3/2003 Odell
2003/0049134 A1 3/2003 Leighton et al.
2003/0061004 A1 3/2003 Discenzo
2003/0063900 A1 4/2003 Wang et al.
2003/0099548 A1 5/2003 Meza et al.
2003/0106147 A1 6/2003 Cohen et al.
2003/0138327 A1 7/2003 Jones et al.
2003/0174450 A1 9/2003 Nakajima et al.
2003/0186453 A1 10/2003 Bell et al.
2003/0196942 A1 10/2003 Jones
2004/0000525 A1 1/2004 Hornsby
2004/0006486 A1 1/2004 Schmidt et al.
2004/0009075 A1 1/2004 Meza et al.
2004/0013531 A1 1/2004 Curry et al.
2004/0016241 A1 1/2004 Street et al.
2004/0025244 A1 2/2004 Loyd et al.
2004/0055363 A1 3/2004 Bristol
2004/0062658 A1 4/2004 Beck et al.
2004/0064292 A1 4/2004 Beck et al.
2004/0071001 A1 4/2004 Balakrishnan et al.
2004/0080325 A1 4/2004 Ogura
2004/0080352 A1 4/2004 Noda et al.
2004/0090197 A1 5/2004 Schuchmann
2004/0095183 A1 5/2004 Swize
2004/0116241 A1 6/2004 Ishikawa et al.
2004/0117330 A1 6/2004 Ehlers et al.
2004/0118203 A1 6/2004 Heger
2004/0149666 A1 8/2004 Leaverton
2004/0205886 A1 10/2004 Goettl
2004/0213676 A1 10/2004 Phillips et al.
2004/0261167 A1 12/2004 Panopoulos
2004/0265134 A1 12/2004 Iimura et al.
2005/0050908 A1 3/2005 Lee et al.
2005/0058548 A1 3/2005 Thomas et al.
2005/0086957 A1 4/2005 Lifson et al.
2005/0092946 A1 5/2005 Fellington et al.
2005/0095150 A1 5/2005 Leone et al.
2005/0097665 A1 5/2005 Goettl
2005/0123408 A1 6/2005 Koehl
2005/0133088 A1 6/2005 Bologeorges
2005/0137720 A1 6/2005 Spira et al.
2005/0156568 A1 7/2005 Yueh
2005/0158177 A1 7/2005 Mehlhorn
2005/0162787 A1 7/2005 Weigel
2005/0167345 A1 8/2005 De Wet et al.
2005/0168900 A1 8/2005 Brochu et al.
2005/0170936 A1 8/2005 Quinn
2005/0180868 A1 8/2005 Miller
2005/0190094 A1 9/2005 Andersen
2005/0193485 A1 9/2005 Wolfe
2005/0195545 A1 9/2005 Mladenik et al.
2005/0226731 A1 10/2005 Mehlhorn et al.
2005/0235732 A1 10/2005 Rush
2005/0248310 A1 11/2005 Fagan et al.
2005/0260079 A1 11/2005 Allen
2005/0281679 A1 12/2005 Niedermeyer
2005/0281681 A1 12/2005 Anderson et al.
2006/0045750 A1 3/2006 Stiles
2006/0045751 A1 3/2006 Beckman et al.
2006/0078435 A1 4/2006 Burza
2006/0078444 A1 4/2006 Sacher
2006/0090255 A1 5/2006 Cohen
2006/0093492 A1 5/2006 Janesky
2006/0106503 A1 5/2006 Lamb et al.
2006/0127227 A1 6/2006 Mehlhorn et al.
2006/0138033 A1 6/2006 Hoal et al.
2006/0146462 A1 7/2006 McMillian
2006/0162787 A1 7/2006 Yeh
2006/0169322 A1 8/2006 Torkelson
2006/0201555 A1 9/2006 Hamza
2006/0204367 A1 9/2006 Meza et al.
2006/0226997 A1 10/2006 Kochan
2006/0235573 A1 10/2006 Guion

(56) References Cited

U.S. PATENT DOCUMENTS

| | | | |
|---|---|---|---|
| 2006/0269426 | A1 | 11/2006 | Llewellyn |
| 2007/0001635 | A1 | 1/2007 | Ho |
| 2007/0041845 | A1 | 2/2007 | Freudenberger |
| 2007/0061051 | A1 | 3/2007 | Maddox |
| 2007/0080660 | A1 | 4/2007 | Fagan et al. |
| 2007/0113647 | A1 | 5/2007 | Mehlhorn |
| 2007/0114162 | A1 | 5/2007 | Stiles et al. |
| 2007/0124321 | A1 | 5/2007 | Szydlo |
| 2007/0154319 | A1 | 7/2007 | Stiles et al. |
| 2007/0154320 | A1 | 7/2007 | Stiles et al. |
| 2007/0154321 | A1 | 7/2007 | Stiles et al. |
| 2007/0154322 | A1 | 7/2007 | Stiles et al. |
| 2007/0154323 | A1 | 7/2007 | Stiles et al. |
| 2007/0160480 | A1 | 7/2007 | Ruffo |
| 2007/0163929 | A1 | 7/2007 | Stiles et al. |
| 2007/0177985 | A1 | 8/2007 | Walls et al. |
| 2007/0183902 | A1 | 8/2007 | Stiles et al. |
| 2007/0187185 | A1 | 8/2007 | Abraham et al. |
| 2007/0188129 | A1 | 8/2007 | Kochan |
| 2007/0212210 | A1 | 9/2007 | Kernan et al. |
| 2007/0212229 | A1 | 9/2007 | Stavale et al. |
| 2007/0212230 | A1 | 9/2007 | Stavale et al. |
| 2007/0258827 | A1 | 11/2007 | Gierke |
| 2008/0003114 | A1* | 1/2008 | Levin ..... F04B 49/002 417/306 |
| 2008/0031751 | A1 | 2/2008 | Littwin et al. |
| 2008/0031752 | A1 | 2/2008 | Littwin et al. |
| 2008/0039977 | A1 | 2/2008 | Clark et al. |
| 2008/0041839 | A1 | 2/2008 | Tran |
| 2008/0063535 | A1 | 3/2008 | Koehl |
| 2008/0095638 | A1 | 4/2008 | Branecky |
| 2008/0095639 | A1 | 4/2008 | Bartos et al. |
| 2008/0131286 | A1 | 6/2008 | Koehl |
| 2008/0131289 | A1 | 6/2008 | Koehl |
| 2008/0131291 | A1 | 6/2008 | Koehl |
| 2008/0131294 | A1 | 6/2008 | Koehl |
| 2008/0131295 | A1 | 6/2008 | Koehl |
| 2008/0131296 | A1 | 6/2008 | Koehl |
| 2008/0140353 | A1 | 6/2008 | Koehl |
| 2008/0152508 | A1 | 6/2008 | Meza et al. |
| 2008/0168599 | A1 | 7/2008 | Caudill et al. |
| 2008/0181785 | A1 | 7/2008 | Koehl |
| 2008/0181786 | A1 | 7/2008 | Meza et al. |
| 2008/0181787 | A1 | 7/2008 | Koehl |
| 2008/0181788 | A1 | 7/2008 | Meza et al. |
| 2008/0181789 | A1 | 7/2008 | Koehl |
| 2008/0181790 | A1 | 7/2008 | Meza et al. |
| 2008/0189885 | A1 | 8/2008 | Erlich et al. |
| 2008/0229819 | A1 | 9/2008 | Mayleben et al. |
| 2008/0260540 | A1 | 10/2008 | Koehl |
| 2008/0288115 | A1 | 11/2008 | Rusnak et al. |
| 2008/0298978 | A1 | 12/2008 | Schulman et al. |
| 2009/0014044 | A1 | 1/2009 | Hartman et al. |
| 2009/0038696 | A1 | 2/2009 | Levin et al. |
| 2009/0052281 | A1 | 2/2009 | Nybo et al. |
| 2009/0104044 | A1 | 4/2009 | Koehl |
| 2009/0143917 | A1 | 6/2009 | Uy et al. |
| 2009/0204237 | A1 | 8/2009 | Sustaeta et al. |
| 2009/0204267 | A1 | 8/2009 | Sustaeta et al. |
| 2009/0208345 | A1 | 8/2009 | Moore et al. |
| 2009/0210081 | A1 | 8/2009 | Sustaeta et al. |
| 2009/0269217 | A1 | 10/2009 | Vijayakumar |
| 2009/0290991 | A1 | 11/2009 | Mehlhorn et al. |
| 2010/0079096 | A1 | 4/2010 | Braun et al. |
| 2010/0154534 | A1 | 6/2010 | Hampton |
| 2010/0166570 | A1 | 7/2010 | Hampton |
| 2010/0197364 | A1 | 8/2010 | Lee |
| 2010/0303654 | A1 | 12/2010 | Petersen et al. |
| 2010/0306001 | A1 | 12/2010 | Discenzo et al. |
| 2010/0312398 | A1 | 12/2010 | Kidd et al. |
| 2011/0036164 | A1 | 2/2011 | Burdi |
| 2011/0044823 | A1 | 2/2011 | Stiles |
| 2011/0052416 | A1 | 3/2011 | Stiles |
| 2011/0061415 | A1 | 3/2011 | Ward |
| 2011/0077875 | A1 | 3/2011 | Tran et al. |
| 2011/0084650 | A1 | 4/2011 | Kaiser et al. |
| 2011/0110794 | A1 | 5/2011 | Mayleben et al. |
| 2011/0280744 | A1 | 11/2011 | Ortiz et al. |
| 2011/0311370 | A1 | 12/2011 | Sloss et al. |
| 2012/0013285 | A1 | 1/2012 | Kasunich et al. |
| 2012/0020810 | A1 | 1/2012 | Stiles, Jr. et al. |
| 2012/0100010 | A1 | 4/2012 | Stiles, Jr. et al. |
| 2013/0106217 | A1 | 5/2013 | Drye |
| 2013/0106321 | A1 | 5/2013 | Drye et al. |
| 2013/0106322 | A1 | 5/2013 | Drye |
| 2014/0018961 | A1 | 1/2014 | Guzelgunler |
| 2014/0372164 | A1 | 12/2014 | Egan et al. |
| 2017/0114788 | A1 | 4/2017 | Stiles, Jr. et al. |

FOREIGN PATENT DOCUMENTS

| | | | |
|---|---|---|---|
| AU | 2007332716 | A1 | 6/2008 |
| AU | 2007332769 | A1 | 6/2008 |
| CA | 2548437 | A1 | 6/2005 |
| CA | 2731482 | A1 | 6/2005 |
| CA | 2517040 | A1 | 2/2006 |
| CA | 2528580 | A1 | 5/2007 |
| CA | 2672410 | A1 | 6/2008 |
| CA | 2672459 | A1 | 6/2008 |
| CN | 1821574 | A | 8/2006 |
| CN | 101165352 | A | 4/2008 |
| DE | 3023463 | A1 | 2/1981 |
| DE | 2946049 | A1 | 5/1981 |
| DE | 29612980 | U1 | 11/1996 |
| DE | 19645129 | A1 | 5/1998 |
| DE | 19736079 | A1 | 2/1999 |
| DE | 29724347 | U1 | 12/2000 |
| DE | 10231773 | A1 | 2/2004 |
| DE | 19938490 | B4 | 4/2005 |
| EP | 150068 | A2 | 7/1985 |
| EP | 226858 | A1 | 7/1987 |
| EP | 246769 | A2 | 11/1987 |
| EP | 306814 | A1 | 3/1989 |
| EP | 314249 | A2 | 5/1989 |
| EP | 709575 | A1 | 5/1996 |
| EP | 735273 | A1 | 10/1996 |
| EP | 833436 | A2 | 4/1998 |
| EP | 831188 | A3 | 2/1999 |
| EP | 916026 | A1 | 5/1999 |
| EP | 978657 | A1 | 2/2000 |
| EP | 1134421 | A1 | 9/2001 |
| EP | 1315929 | A1 | 6/2003 |
| EP | 1429034 | A2 | 6/2004 |
| EP | 1585205 | A2 | 10/2005 |
| EP | 1630422 | A2 | 3/2006 |
| EP | 1698815 | A1 | 9/2006 |
| EP | 1790858 | A1 | 5/2007 |
| EP | 1995462 | A2 | 11/2008 |
| EP | 2102503 | A2 | 9/2009 |
| EP | 2122171 | A2 | 11/2009 |
| EP | 2122172 | A2 | 11/2009 |
| EP | 2273125 | A2 | 1/2011 |
| FR | 2529965 | A1 | 1/1984 |
| FR | 2703409 | A1 | 10/1994 |
| GB | 2124304 | A | 2/1984 |
| JP | 50010270 | A | 2/1975 |
| JP | 55072678 | A | 5/1980 |
| MX | 2009006258 | A | 12/2009 |
| WO | 9804835 | A1 | 2/1998 |
| WO | 0042339 | A1 | 7/2000 |
| WO | 0127508 | A1 | 4/2001 |
| WO | 0147099 | A1 | 6/2001 |
| WO | 0218826 | A1 | 3/2002 |
| WO | 03025442 | A1 | 3/2003 |
| WO | 93099705 | A2 | 12/2003 |
| WO | 2004006416 | A1 | 1/2004 |
| WO | 2004073772 | A1 | 9/2004 |
| WO | 2004088694 | A1 | 10/2004 |
| WO | 2005055694 | A2 | 6/2005 |
| WO | 2005011473 | A3 | 7/2005 |
| WO | 2005111473 | A2 | 11/2005 |
| WO | 2006069568 | A1 | 7/2006 |
| WO | 2008073329 | A2 | 6/2008 |
| WO | 2008073330 | A2 | 6/2008 |

(56) References Cited

FOREIGN PATENT DOCUMENTS

| | | | |
|---|---|---|---|
| WO | 2008073386 | A2 | 6/2008 |
| WO | 2008073413 | A2 | 6/2008 |
| WO | 2008073418 | A2 | 6/2008 |
| WO | 2008073433 | A2 | 6/2008 |
| WO | 2008073436 | A2 | 6/2008 |
| WO | 2011100067 | A1 | 8/2011 |
| ZA | 200506869 | A | 5/2006 |
| ZA | 200509691 | A | 11/2006 |
| ZA | 200904747 | A | 7/2010 |
| ZA | 200904849 | A | 7/2010 |
| ZA | 200904850 | A | 7/2010 |

OTHER PUBLICATIONS

U .S. Court of Appeals for the Federal Circuit, Notice of Entry of Judgment, accompanied by Opinion, in Case No. 2017-1124, Document 54-1, filed and entered Feb. 26, 2018, pp. 1-10.
U.S. Patent Trial and Appeal Board's Rule 36 Judgment, without opinion, in Case No. 2016-2598, dated Aug. 15, 2017, pp. 1-2.
U.S. Appl. No. 12/869,570 Appeal Decision dated May 24, 2016.
Decision on Appeal issued in Appeal No. 2015-007909, regarding *Hayward Industries, Inc.* v. *Pentair Ltd.*, dated Apr. 1, 2016, 19 pages.
Allen-Bradley; "1336 Plus II Adjustable Frequency AC Drive with Sensorless Vector User Manual;" Sep. 2005; pp. 1-212.
Flotec Owner's Manual, dated 2004. 44 pages.
Glentronics Home Page, dated 2007. 2 pages.
Goulds Pumps SPBB Battery Back-Up Pump Brochure, dated 2008. 2 pages.
Goulds Pumps SPBB/SPBB2 Battery Backup Sump Pumps, dated 2007.
ITT Red Jacket Water Products Installation, Operation and Parts Manual, dated 2009. 8 pages.
Liberty Pumps PC-Series Brochure, dated 2010. 2 pages.
"Lift Station Level Control" by Joe Evans PhD, www.pumped101.com, dated Sep. 2007. 5 pages.
The Basement Watchdog A/C-D/C Battery Backup Sump Pump System Instruction Manual and Safety Warnings, dated 2010. 20 pages.
The Basement Watchdog Computer Controlled A/C-D/C Sump Pump System Instruction Manual, dated 2010. 17 pages.
Pentair Water Ace Pump Catalog, dated 2007, 44 pages.
ITT Red Jacket Water Products RJBB/RJBB2 Battery Backup Sump Pumps; May 2007, 2 pages.
USPTO Patent Trial and Appeal Board, Paper 43—Final Written Decision, Case IPR2013-00287, U.S. Pat. No. 7,704,051 B2, Nov. 19, 2014, 28 pages.
Danfoss, VLT 8000 AQUA Operating Instructions, coded MG.80. A2.02 in the footer, 181 pages, before 2004.
Per Brath—Danfoss Drives A/S, Towards Autonomous Control of HVAC Systems, thesis with translation of Introduction, Sep. 1999, 216 pages.
Karl Johan Ãâƒ€¦;strÃƒâ"mand Bjãƒâ€"rn Wittenmark—Lund Institute of Technology, Adaptive Control—Second Edition, book, Copyright 1995, 589 pages, Addison-Wesley Publishing Company, United States and Canada.
Bimal K. Bose—The University of Tennessee, Knoxville, Modem Power Electronics and AC Drives, book, Copyright 2002, 728 pages, Prentice-Hall, Inc., Upper Saddle River, New Jersey.
Waterworld, New AC Drive Series Targets Water, Wastewater Applications, magazine, Jul. 2002, 5 pages, vol. 18, Issue 7.
Texas Instruments, TMS320F/C240 DSP Controllers Peripheral Library and Specific Devices, Reference Guide, Nov. 2002, 485 pages, printed in U.S.A.
Microchip Technology Inc., PICmicroÃ‚Ã® Advanced Analog Microcontrollers For 12-Bit ADC on 8-Bit MCUs, Convert to Microchip, brochure, Dec. 2000, 6 pages, Chandler, Arizona.
W.K. Ho, S.K. Panda, K.W. Lim, F.S. Huang—Department of Electrical Engineering, National University of Singapore, Gain-scheduling control of the Switched Reluctance Motor, Control Engineering Practice 6, copyright 1998, pp. 181-189, Elsevier Science Ltd.
Jan Eric Thorsen—Danfoss, Technical Paper—Dynamic simulation of DH House Stations, presented by 7. Dresdner FemwÃƒÃ¤rme-Kolloquium Sep. 2002, 10 pages, published in Euro Heat & Power Jun. 2003.
Texas Instruments, Electronic Copy of TMS320F/C240 DSP Controllers Reference Guide, Peripheral Library and Specific Devices, Jun. 1999, 474 pages.
Rajwardhan Patil, et al., A Multi-Disciplinary Mechatronics Course with Assessment—Integrating Theory and Application through Laboratory Activities, International Journal of Engineering Education, copyright 2012, pp. 1141-1149, vol. 28, No. 5, TEMPUS Publications, Great Britain.
James Shirley, et al., A mechatronics and material handling systems laboratory: experiments and case studies, International Journal of Electrical Engineering Education 48/1, pp. 92-103, 2012.
9PX-42—Hayward Pool Systems; "Hayward EcoStar & EcoStar SVRS Variable Speed Pumps Brochure;" Civil Action 5:11-CV-00459D; 2010.
205-24—Exh23—PiaintifTs Preliminary Disclosure of Asserted Claims and Preliminary Infringement Contentions; cited in Civil Action 5:11-cv-00459; Feb. 21, 2012.
PX-34—Pentair; "IntelliTouch Pool & Spa Control System User's Guide"; pp. 1-129; 2011; cited in Civil Action 5:11-cv-00459; 2011.
PX-138—Deposition of Dr. Douglas C. Hopkins; pp. 1-391; 2011; taken in Civil Action 10-cv-1662.
PX-141—Danfoss; "Whitepaper Automatic Energy Optimization;" pp. 1-4; 2011; cited in Civil Action 5:11-cv-00459.
9PX10—Pentair; "IntelliPro VS+SVRS Intelligent Variable Speed Pump;" 2011; pp. 1-6; cited in Civil Action 5:11-cv-00459D.
9PX11—P—; "IntelliTouch Pool & Spa Control Control Systems;" 2011; pp. 1-5; cited in Civil Action 5:11-cv-004590.
Robert S. Carrow; "Electrician's Technical Reference-Variable Frequency Drives;" 2001; pp. 1-194.
Baldor; "Balder Motors and Drives Series 14 Vector Drive Control Operating & Technical Manual;" Mar. 22, 1992; pp. 1-92.
Commander; "Commander SE Advanced User Guide;" Nov. 2002; pp. 1-118.
Baldor; "Baldor Series 10 Inverter Control: Installation and Operating Manual"; Feb. 2000; pp. 1-74.
Dinverter; "Dinverter 28 User Guide;" Nov. 1998; pp. 1-94.
Pentair Pool Products, "IntelliFlo 4x160 a Breakthrough Energy-Efficiency and Service Life;" pp. 1-4; Nov. 2005; www.pentairpool.com.
Pentair Water and Spa, Inc. "The Pool Pro's guide to Breakthrough Efficiency, Convenience & Profitability," pp. 1-8, Mar. 2006; www.pentairpool.com.
Danfoss; "VLT8000 Aqua Instruction Manual;" Apr. 16, 2004; pp. 1-71.
"Product Focus—New AC Drive Series Target Water, Wastewater Applications;" WaterWorld Articles; Jul. 2002; pp. 1-2.
Pentair; "Pentair RS-485 Pool Controller Adapter" Published Advertisement; Mar. 22, 2002; pp. 1-2.
Compool; "Compool CP3800 Pool-Spa Control System Installation and Operating Instructions;" Nov. 7, 1997; pp. 1-45.
Hayward; "Hayward Pro-Series High-Rate Sand Filter Owner's Guide," 2002; pp. 1-4.
Danfoss; "Danfoss VLT 6000 Series Adjustable Frequency Drive Installation, Operation and Maintenance Manual;" Mar. 2000; pp. 1-118.
Pentair Pool Products, WhisperFlo Pump Owner Manual, Jun. 5, 2001, 10 pages.
Franklin Electric; "Franklin Application Installation Data;" vol. 21, No. 5, Sep./Oct. 2003; pp. 1-2; www.franklin-electric.com.
Grundfos; "Grundfos SmartFio SQE Constant Pressure System;" Mar. 2003; pp. 1-2; USA.
Grundfos; "Uncomplicated Electronics . . . Advanced Design;" pp. 1-10; before 2004.
Grundfos; "CU301 Installation & Operating Instructions;" Sep. 2005; pp. 1-30; Olathe, KS USA.

(56) References Cited

OTHER PUBLICATIONS

ITT Corporation; "Goulds Pumps Balanced Flow Constant Pressure Controller for 2 HP Submersible Pumps;" Jun. 2005; pp. 1-4 USA.
ITT Corporation; "Goulds Pumps Balanced Flow Constant Pressure Controller for 3 HP Submersible Pumps;" Jun. 2005; pp. 1-4; USA.
Franklin Electric; Constant Pressure in Just the Right Size; Aug. 2006; pp. 1-4; Bluffton, IN USA.
ITT Corporation; "Goulds Pumps Balanced Flow;" Jul. 2006; pp. 1-8.
ITT Corporation; "Goulds Pumps Balanced Flow Submersible Pump Controller;" Jul. 2007; pp. 1-12.
Franklin Electric; "Monodrive MonodriveXT Single-Phase Constant Pressure;" Sep. 2008; pp. 1-2 Bluffton, IN USA.
Grundfos; "CU301 Installation & Operation Manual;" Apr. 2009; pp. 1-2; before 2004; www.grundfos.com.
1—Complaint Filed by Pentair Water Pool & Spa, Inc. and Danfoss Drives A/S with respect to Civil Action No. 5:11-cv-00459-D; Aug. 31, 2011.
22—Memorandum in Support of Motion for Preliminary Injunction by Plaintiffs with respect to Civil Action 5:11-cv-00459-D; Sep. 2, 2011.
23—Declaration of E. Randolph Collins, Jr. in Support of Motion for Preliminary Injunction with respect to Civil Action 5:11-cv-00459-D; Sep. 30, 2011.
24—Declaration of Zack Picard in Support of Motion for Preliminary Injunction with respect to Civil Action 5:11-cv-00459-D; Sep. 30, 2011.
32-Answerto Complaint with Jury Demand & Counterclaim Against Plaintiffs by Hayward Pool Products & Hayward Industries for Civil Action 5:11-cv-004590; Oct. 12, 2011.
7-Motion for Preliminary Injunction by Danfoss Drives AIS & Pentair Water Pool & Spa, Inc. with respect to Civil Action No. 5:11-cv-00459-D; Sep. 30, 2011.
Docket Report for Case No. 5:11-cv-00459-D; Nov. 2012.
USPTO Patent Trial and Appeal Board, Paper 47—Final Written Decision, Case IPR2013-00285, U.S. Pat. No. 8,019,479 B2, Nov. 19, 2014, 39 pages.
540X37—Danfoss; "VLT 8000 Aqua Fact Sheet;" Jan. 2002; pp. 1-3; cited in Civil Action 5:11-cv-004590.
540X38—Danfoss; "VLT 6000 Series Installation, Operation & Maintenance Manual;" Mar. 2000; pp. 1-118; cited in Civil Action 5:11-cv-004590.
540X45—Hopkins; "Synthesis of New Class of Converters that Utilize Energy Recirculation;" pp. 1-7; cited in Civil Action 5:11-cv-004590; 1994.
540X46—Hopkins; "High-Temperature, High-Oensity . . . Embedded Operation;" pp. 1-8; cited in Civil Action 5:11-cv-004590; Mar. 2006.
540X47—Hopkins; "Optimally Selecting Packaging Technologies . . . Cost & Performance;" pp. 1-9; cited in Civil Action 5:11-cv-004590; Jun. 1999.
9PX5—Pentair; Selected Website Pages; pp. 1-29; cited in Civil Action 5:11-cv-004590; Sep. 2011.
9PX6—Pentair; "IntelliFio Variable Speed Pump" Brochure; 2011; pp. 1-9; cited in Civil Action 5:11-cv-004590.
9PX7—Pentair; "IntelliFio VF Intelligent Variable Flow Pump;" 2011; pp. 1-9; cited in Civil Action 5:11-cv-004590.
9PX8—Pentair; "IntelliFio VS+SVRS Intelligent Variable Speed Pump;" 2011; pp. 1-9; cited in Civil Action 5:11-cv-004590.
9PX9—STA-RITE; "IntelliPro Variable Speed Pump;" 2011; pp. 1-9; cited in Civil Action 5:11-cv-004590.
9PX14—Pentair; "IntelliFio Installation and User's Guide;" pp. 1-53; Jul. 26, 2011; Sanford, NC; cited in Civil Action 5:11-cv-004590.
9PX16—Hayward Pool Products; "EcoStar Owner's Manual (Rev. B);" pp. 1-32; Elizabeth, NJ; cited in Civil Action 5:11-cv-00459D; 2010.
9PX17—Hayward pool Products; "EcoStar & EcoStar SVRS Brochure;" pp. 1-7; Elizabeth, NJ; cited in Civil Action 5:11-cv-00459D; Sep. 30, 2011.
9PX19—Hayward Pool Products;" Hayward Energy Solutions Brochure;" pp. 1-3; www.haywardnet.com; cited in Civil Action 5:11-cv-00459D; Sep. 2011.
9PX20—Hayward Pool Products; "ProLogic Installation Manual (Rev. G);" pp. 1-25; Elizabeth, NJ; cited in Civil Action 5:11-cv-00459D; Sep. 2011.
9PX21—Hayward Pool Products; "ProLogic Operation Manual (Rev. F);" pp. 1-27; Elizabeth, NJ; cited in Civil Action 5:11-cv-00459D; Sep. 2011.
9PX22—Hayward Pool Products; "Wireless & Wired Remote Controls Brochure;" pp. 1-5; 2010; Elizabeth, NJ cited in Civil Action 5:11-cv-00459D.
9PX23—Hayward Pool Products; Selected Pages from Hayward's Website:/www.hayward-pool.com; pp. 1-27; cited in Civil Action 5:11-cv-004590; Sep. 2011.
9PX28—Hayward Pool Products; "Selected Pages from Hayward's Website Relating to EcoStar Pumps;" p. 1 cited in Civil Action 5:11-cv-00459D; Sep. 2011.
9PX29-Hayward Pool Products; "Selected Page from Hayward's Website Relating to EcoStar SVRS Pumps;" cited in Civil Action 5:11-cv-00459; Sep. 2011.
9PX30—Hayward Pool Systems; "Selected Pages from Hayward's Website Relating to ProLogic Controllers;" pp. 1-5; Civil Action 5:11-cv-00459D; Sep. 2011.
Shabnam Moghanrabi; "Better, Stronger, Faster;" Pool & Spa News, Sep. 3, 2004; pp. 1-5; www/poolspanews.com.
Grundfos Pumps Corporation; "The New Standard in Submersible Pumps;" Brochure; pp. 1-8; Jun. 1999 Fresno, CA USA.
Grundfos Pumps Corporation; "Grundfos SQ/SQE Data Book;" pp. 1-39; Jun. 1999; Fresno, CA USA.
Goulds Pumps; "Balanced Flow System Brochure;" pp. 1-4; 2001.
Goulds Pumps; "Balanced Flow Submersible System Installation, Operation & Trouble-Shooting Manual;" pp. 1-9; 2000; USA.
Goulds Pumps; "Balanced Flow Submersible System Informational Seminar;" pp. 1-22; before 2004.
Goulds Pumps; "Balanced Flow System Variable Speed Submersible Pump" Specification Sheet; pp. 1-2; Jan. 2000; USA.
Goulds Pumps; Advertisement from "Pumps & Systems Magazine;" entitled "Cost Effective Pump Protection+ Energy Savings," Jan. 2002; Seneca Falls, NY.
Goulds Pumps; "Hydro-Pro Water System Tank Installation, Operation & Maintenance Instructions;" pp. 1-30; Mar. 31, 2001; Seneca Falls, NY USA.
Goulds Pumps; "Pumpsmart Control Solutions" Advertisement from Industrial Equipment News; Aug. 2002; New York, NY USA.
Goulds Pumps; "Model BFSS List Price Sheet;" Feb. 5, 2001.
Goulds Pumps; "Balanced Flow System Model BFSS Variable Speed Submersible Pump System" Brochure; pp. 1-4; Jan. 2001; USA.
Goulds Pumps; "Balanced Flow System Model BFSS Variable Speed Submersible Pump" Brochure; pp. 1-3; Jan. 2000; USA.
Goulds Pumps; "Balanced Flow System . . . The Future of Constant Pressure Has Arrived;" before 2004.
Amtrol Inc.; "Amtrol Unearths the Facts About Variable Speed Pumps and Constant Pressure Valves;" pp. 1-5; Mar. 2002; West Warwick, RI USA.
Franklin Electric; "CP Water-Subdrive 75 Constant Pressure Controller" Product Data Sheet; May 2001; Bluffton, IN USA.
Franklin Electric; "Franklin Aid, Subdrive 75: You Made It Better;" vol. 20, No. 1; pp. 1-2; Jan./Feb. 2002; www.franklin-electric.com.
Grundfos; "SQ/SQE—A New Standard in Submersible Pumps;" before 2004; pp. 1-14; Denmark.
Grundfos; "JetPaq—The Complete Pumping System;" before2004;; pp. 1-4; Clovis, CA USA.
Email Regarding Grundfos' Price Increases/SQ/SQE Curves; pp. 1-7; Dec. 19, 2001.
Email Regarding Grundfos' Price Increases/SQ/SQE Curves; pp. 1-7; Dec. 19, 2001 F.E. Myers; "Featured Product: F.E. Myers Introducts Revolutionary Constant Pressure Water System;" pp. 1-8; Jun. 28, 2000; Ashland, OH USA.
"Water Pressure Problems" Published Article; The American Well Owner; No. 2, Jul. 2000.

(56) References Cited

OTHER PUBLICATIONS

Bjarke Soerensen; "Have You Chatted With Your Pump Today?" before 2004, Grundfos Pump University; pp. 1-2; USA.
"Understanding Constant Pressure Control;" pp. 1-3; Nov. 1, 1999.
"Constant Pressure is the Name of the Game;" Published Article from National Driller; Mar. 2001.
Sje-Rhombus; "Variable Frequency Drives for Constant Pressure Control;" Aug. 2008; pp. 1-4; Detroit Lakes, MN USA.
Sje-Rhombus; "Constant Pressure Controller for Submersible Well Pumps;" Jan. 2009; pp. 1-4; Detroit Lakes, MN USA.
Sje-Rhombus; "SubCon Variable Frequency Drive;" Dec. 2008; pp. 1-2; Detroit Lakes, MN USA.
Grundfos; "SmartFio SQE Constant Pressure System;" Mar. 2002; pp. 1-4; Olathe, KS USA.
Brochure entitled "Constant Pressure Water for Private Well Systems," for Myers Pentair Pump Group, Jun. 28, 2000.
Brochure for AMTROL, Inc. entitled "AMTROL unearths the facts about variable speed pumps and constant pressure valves," Mar. 2002.
Goulds Pumps "Balanced Flow Systems" Installation Record, before 2004.
Texas Instruments, Digital Signal Processing Solution for AC Induction Motor, Application Note, BPRA043 (1996).
Texas Instruments, Zhenyu Yu and David Figoli, DSP Digital Control System Applications—AC Induction Motor Control Using Constant V/Hz Principle and Space Vector PWM Technique with TMS320C240, Application Report No. SPRA284A (Apr. 1998).
Texas Instruments, TMS320F/C240 DSP Controllers Reference Guide Peripheral Library and Specific Devices, Literature No. SPRU 161D (Nov. 2002).
Texas Instruments, MSP430x33x Ā¢â,¬â€œ Mixed Signal Microcontrollers, SLAS 163 (Feb. 1998).
Microchip Technology, Inc., PICMicro Mid-Range MCU Family Reference Manual (Dec. 1997).
7—Motion for Preliminary Injunction by Danfoss Drives A/S & Pentair Water Pool & Spa, Inc. with respect to Civil Action No. 5:11-CV-00459D, filed Sep. 30, 2011.
540X48—Hopkins; "Partitioning Digitally . . . Applications to Ballasts;" pp. 1-6; cited in Civil Action 5:11-cv-00459D, Mar. 2002.
Load Controls Incorporated, product web pages including Affidavit of Christopher Butler of Internet Archive attesting to the authenticity of the web pages, dated Apr. 17, 2013, 19 pages.
Cliff Wyatt, Monitoring Pumps, World Pumps, vol. 2004, Issue 459, Dec. 2004, pp. 17-21.
WEN Technology, Inc., Unipower, HPL110 Digital Power Monitor Installation and Operation, copyright 1999, pp. 1-20, Raleigh, North Carolina.
WEN Technology, Inc., Unipower, HPL110, HPL420 Programming Suggestions for Centrifugal Pumps, copyright 1999, 4 pages, Raleigh, North Carolina.
Danfoss, Aqua Drive, The ultimate solution for Water, Wastewater, & Irrigation, May 2007, pp. 1-16.
Danfoss, Salt Drive Systems, "Increase oil & gas production, Minimize energy consumption", copyright 2011, pp. 1-16.
Schlumberger Limited, Oilfield Glossary, website Search Results for "pump-off", copyright 2014, 1 page.
45—Plaintiffs'Reply to Defendants' Answer to Complaint & Counterclaim for Civil Action 5:11-cv-00459D, , filed Nov. 2, 2011.
50—Amended Answer to Complaint & Counterclaim by Defendants for Civil Action 5:11-cv-00459D, filed Nov. 23, 2011.
54DX32—Hopkins; "High-Temperature, High-Density . . . Embedded Operation;" pp. 1-8; cited in Civil Action 5:11-cv-00459D, Mar. 2006.
Pentair; "Pentair IntelliTouch Operating Manual;" May 22, 2003; pp. 1-60.
51—Response by Defendants in Opposition to Motion for Preliminary Injunction for Civil Action 5:11-cv-00459D; Dec. 2, 2011.
Amended Complaint Filed by Pentair Water Pool & Spa, Inc. and Danfoss Drives A/S with respect to Civil Action No. 5:11-cv-00459, adding U.S. Pat. No. 8,043,070, filed Jan. 17, 2012.
53—Declaration of Douglas C. Hopkins & Exhibits re Response Opposing Motion for Preliminary Injunction for Civil Action 5:11-cv-00459D; Dec. 2, 2011.
89—Reply to Response to Motion for Preliminary Injunction Filed by Danfoss Drives A/S & Pentair Water Pool & Spa, Inc. for Civil Action 5:11-cv-004590; Jan. 3, 2012.
105—Declaration re Memorandum in Opposition, Declaration of Lars Hoffmann Berthelsen for Civil Action 5:11-cv-00459D; Jan. 11, 2012.
112—Amended Complaint Against All Defendants, with Exhibits for Civil Action 5:11-cv-00459D; Jan. 17, 2012.
119—Order Denying Motion for Preliminary Injunction for Civil Action 5:11-cv-00459D; Jan. 23, 2012.
123—Answer to Amended Complaint, Counterclaim Against Danfoss Drives A/S, Pentair Water Pool & Spa, Inc. for Civil Action 5:11-cv-00459D; Jan. 27, 2012.
152—0rder Denying Motion for Reconsideration for Civil Action 5:11-cv-00459D; Apr. 4, 2012.
168—Amended Motion to Stay Action Pending Reexamination of Asserted Patents by Defendants for Civil Action 5:11-cv-004590; Jun. 13, 2012.
174—Notice and Attachments re Joint Claim Construction Statement for Civil Action 5:11-cv-00459D; Jun. 5, 2012.
186—0rder Setting Hearings—Notice of Markman Hearing Set for Oct. 17, 2012 for Civil Action 5:11-cv-00459D; Jul. 12, 2012.
204—Response by Plaintiffs Opposing Amended Motion to Stay Action Pending Reexamination of Asserted Patents for Civil Action 5:11-cv-004590; Jul. 2012.
210—0rder Granting Joint Motion for Leave to Enlarge Page Limit for Civil Action 5:11-cv-004590; Jul. 2012.
218—Notice re Plaintiffs re Order on Motion for Leave to File Excess Pages re Amended Joint Claim Construction Statement for Civil Action 5:11-cv-004590; Aug. 2012.
54DX16—Hayward EcoStar Technical Guide (Version2); 2011; pp. 1-51; cited in Civil Action 5:11-cv-004590.
54DX17—Hayward ProLogic Automation & Chlorination Operation Manual (Rev. F); pp. 1-27; Elizabeth, NJ; cited in Civil Action 5:11-cv-004590; Dec. 2, 2011.
54DX18—Stmicroelectronics; "An1946—Sensorless BLOC Motor Control & BEMF Sampling Methods with ST7MC;" 2007; pp. 1-35; Civil Action 5:11-cv-004590.
54DX19—Stmicroelectronics; "AN1276 BLOC Motor Start Routine for ST72141 Microcontroller;" 2000; pp. 1-18; cited in Civil Action 5:11-cv-004590.
54DX21—Danfoss; "VLT 8000 Aqua Instruction Manual;" Apr. 2004; 1-210; Cited in Civil Action 5:11-cv-004590.
54DX22—Danfoss; "VLT 8000 Aqua Instruction Manual;" pp. 1-35; cited in Civil Action 5:11-cv-004590; Dec. 2, 2011.
54DX23—Commander; "Commander SE Advanced User Guide;" Nov. 2002; pp. 1-190; cited in Civil Action 5:11-cv-004590.
540X30—Sabbagh et al.; "A Model for OptimaL.Control of Pumping Stations in Irrigation Systems;" Jul. 1988; NL pp. 119-133; Civil Action 5:11-cv-004590.
540X31—Danfoss; "VLT 5000 FLUX Aqua DeviceNet Instruction Manual;" Apr. 28, 2003; pp. 1-39; cited in Civil Action 5:11-cv-004590.
540X32—Danfoss; "VLT 5000 FLUX Aqua Profibus Operating Instructions;" May 22, 2003; 1-64; cited in Civil Action 5:11-cv-004590.
540X33—Pentair; "IntelliTouch Owner's Manual Set-Up & Programming;" May 22, 2003; Sanford, NC; pp. 1-61 cited in Civil Action 5:11-cv-004590.
540X34—Pentair; "Compool3800 Pool-Spa Control System Installation & Operating Instructions;" Nov. 7, 1997; pp. 1-45; cited in Civil Action 5:11-cv-004590.
540X35—Pentair Advertisement in "Pool & Spa News;" Mar. 22, 2002; pp. 1-3; cited in Civil Action 5:11-cv-004590.
5540X36—Hayward; "Pro-Series High-Rate Sand Filter Owner's Guide;" 2002; Elizabeth, NJ; pp. 1-5; cited in Civil Action 5:11-cv-00459D.

* cited by examiner

PRIMING PROTECTION

RELATED APPLICATIONS

This application is a divisional of U.S. application Ser. No. 14/877,817, filed on Oct. 7, 2015, which is a divisional of U.S. application Ser. No. 14/071,547, filed on Nov. 4, 2013, which is abandoned, which is a divisional of U.S. application Ser. No. 13/220,537 filed on Aug. 29, 2011, issued as U.S. Pat. No. 8,573,952 on Nov. 5, 2013, which is a continuation of U.S. application Ser. No. 11/608,001, filed on Dec. 7, 2006, issued as U.S. Pat. No. 8,469,675 on Jun. 25, 2013, which is a continuation-in-part of U.S. application Ser. No. 11/286,888, filed on Nov. 23, 2005, issued as U.S. Pat. No. 8,019,479 on Sep. 13, 2011, and of U.S. application Ser. No. 10/926,513, filed on Aug. 26, 2004, issued as U.S. Pat. No. 7,874,808 on Jan. 25, 2011, the entire disclosures of which are incorporated herein by reference.

FIELD OF THE INVENTION

The present invention relates generally to control of a pump, and more particularly to control of a variable speed pumping system for a pool, a spa or other aquatic application.

BACKGROUND OF THE INVENTION

Conventionally, a pump to be used in an aquatic application such as a pool or a spa is operable at a finite number of predetermined speed settings (e.g., typically high and low settings). Typically, these speed settings correspond to the range of pumping demands of the pool or spa at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the aquatic application conditions and/or pumping demands.

Generally, pumps of this type must be primed before use. For example, the pump and the pumping system should be filled with liquid (e.g., water) and contain little or no gas (e.g., air), or else the pump may not prime. If the pump is operated in an unprimed condition (e.g., the gas has not been removed from the system), various problems can occur, such as an overload condition or loss of prime condition. In another example, if too much gas is in the system, a dry run condition can occur that can cause damage to the pump. In yet other examples, operation of the pump in an unprimed condition can cause a water hammer condition and/or a voltage spike that can damage the pump and/or even various other elements of the pumping system.

Conventionally, to prime a pump, a user can manually fill the pump with water and operate the pump, in a repetitious fashion, until the pump is primed. However, the user must be careful to avoid the aforementioned problems associated with operating the pump in an unprimed condition during this process. Thus, it would be beneficial to utilize an automated priming function to operate the pump according to an automated program, or the like, that can monitor the priming status and can automatically alter operation of the pump to avoid the aforementioned problems. However, since each aquatic application is different, the automated priming function must be adjustable and/or scalable, such as in terms of water flow or pressure through the system and/or time required to prime the pump of a specific aquatic application.

Accordingly, it would be beneficial to provide a pumping system that could be readily and easily adapted to respond to a variety of priming conditions. Further, the pumping system should be responsive to a change of conditions and/or user input instructions.

SUMMARY OF THE INVENTION

In accordance with one aspect, the present invention provides a pumping system for an aquatic application. The pumping system includes a pump, a motor coupled to the pump, and a controller in communication with the motor. The controller is configured to store a timeout time value. The controller is also configured to initiate a pump priming process and subsequently initiate a timeout counter to begin counting a counter time value. The controller is configured to initiate a timeout interrupt routine that interrupts the pump priming process when the counter time value exceeds the timeout time value. The timeout interrupt routine includes shutting down the motor.

In accordance with another aspect, the present invention provides a pumping system. The pumping system includes a pump, a motor coupled to the pump, and a controller in communication with the motor. The controller is configured to store a timeout time value and initiate a timeout counter to begin counting a counter time value. The controller is also configured to receive a performance value that is indicative of an actual power consumption of the motor and compare the performance value to a reference value indicative of a reference power value of the motor. The controller is further configured to prime and run the pump when the performance value is less than the reference value and to continue to do so until the performance value is equal to or greater than the reference value unless the counter time value exceeds the timeout time value.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
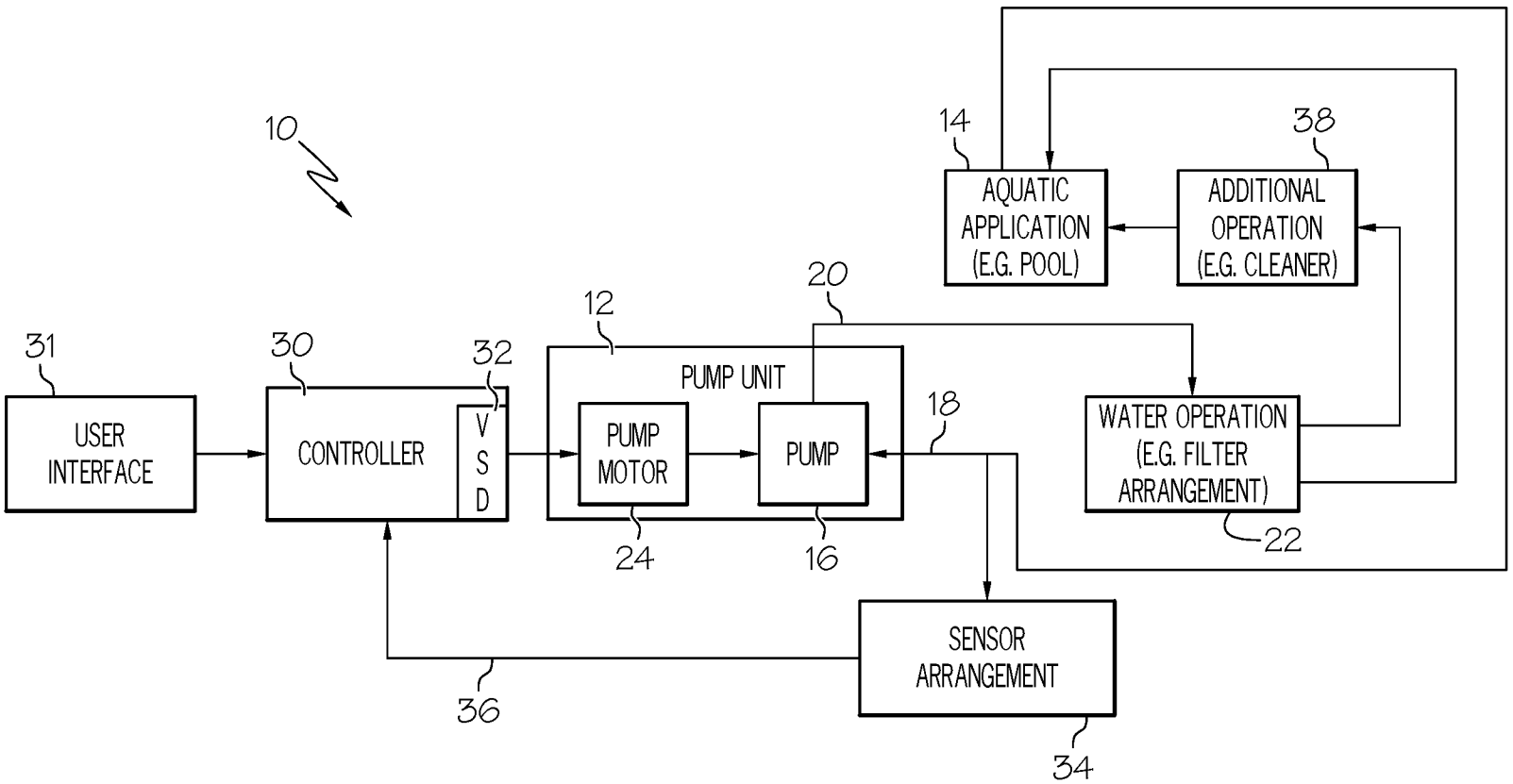
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The pool 14 is one example of an aquatic application with which the present invention may be utilized. The phrase "aquatic application" is used generally herein to refer to any reservoir, tank, container or structure, natural or man-made, having a fluid, capable of holding a fluid, to which a fluid is delivered, or from which a fluid is withdrawn. Further, "aquatic application" encompasses any feature associated with the operation, use or maintenance of the aforementioned reservoir, tank, container or structure. This definition of "aquatic application" includes, but is not limited to pools, spas, whirlpool baths, landscaping ponds, water jets, waterfalls, fountains, pool filtration equipment, pool vacuums, spillways and the like. Although each of the examples provided above includes water, additional applications that include liquids other than water are also within the scope of the present invention. Herein, the terms pool and water are used with the understanding that they are not limitations on the present invention.

A water operation 22 is performed upon the water moved by the pump 16. Within the shown example, water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., recirculation of the water in a waterfall or spa environment).

Turning to the filter arrangement 22, any suitable construction and configuration of the filter arrangement is possible. For example, the filter arrangement 22 may include a skimmer assembly for collecting coarse debris from water being withdrawn from the pool, and one or more filter components for straining finer material from the water.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is an induction motor. In yet another embodiment, the pump motor 24 can be a synchronous or asynchronous motor. The pump motor 24 operation is infinitely variable within a range of operation (i.e., zero to maximum operation). In one specific example, the operation is indicated by the RPM of the rotational force provided to rotate the impeller of the pump 16. Thus, either or both of the pump 16 and/or the motor 24 can be configured to consume power during operation.

A controller 30 provides for the control of the pump motor 24 and thus the control of the pump 16. Within the shown example, the controller 30 includes a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase AC current. Any suitable technique and associated construction/configuration may be used to provide the three-phase AC current. The variable speed drive supplies the AC electric power at a changeable frequency to the pump motor to drive the pump motor. The construction and/or configuration of the pump 16, the pump motor 24, the controller 30 as a whole, and the variable speed drive 32 as a portion of the controller 30, are not limitations on the present invention. In one possibility, the pump 16 and the pump motor 24 are disposed within a single housing to form a single unit, and the controller 30 with the variable speed drive 32 are disposed within another single housing to form another single unit. In another possibility, these components are disposed within a single housing to form a single unit. Further still, the controller 30 can receive input from a user interface 31 that can be operatively connected to the controller in various manners.

The pumping system 10 has means used for control of the operation of the pump. In accordance with one aspect of the present invention, the pumping system 10 includes means for sensing, determining, or the like one or more parameters or performance values indicative of the operation performed upon the water. Within one specific example, the system includes means for sensing, determining or the like one or more parameters or performance values indicative of the movement of water within the fluid circuit.

The ability to sense, determine or the like one or more parameters or performance values may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 can include at least one sensor used to determine flow rate of the water moving within the fluid circuit and/or includes at least one sensor used to determine flow pressure of the water moving within the fluid circuit. In one example, the sensor arrangement 34 can be operatively connected with the water circuit at/adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the controller 30 to provide the sensory information thereto. Further still, one or more sensor arrangement(s) 34 can be used to sense parameters or performance values of other components, such as the motor (e.g., motor speed or power consumption) or even values within program data running within the controller 30.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the controller 30, via performance of a program, algorithm or the like, to perform various functions, and examples of such are set forth below. Also, it is to be appreciated that additional functions and features may be separate or combined, and that sensor information may be obtained by one or more sensors.

With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the aquatic application to the pump such as debris accumulation or the lack of accumulation, within the filter arrangement 34. As such, the monitored information is indicative of the condition of the filter arrangement.

Figure 2:
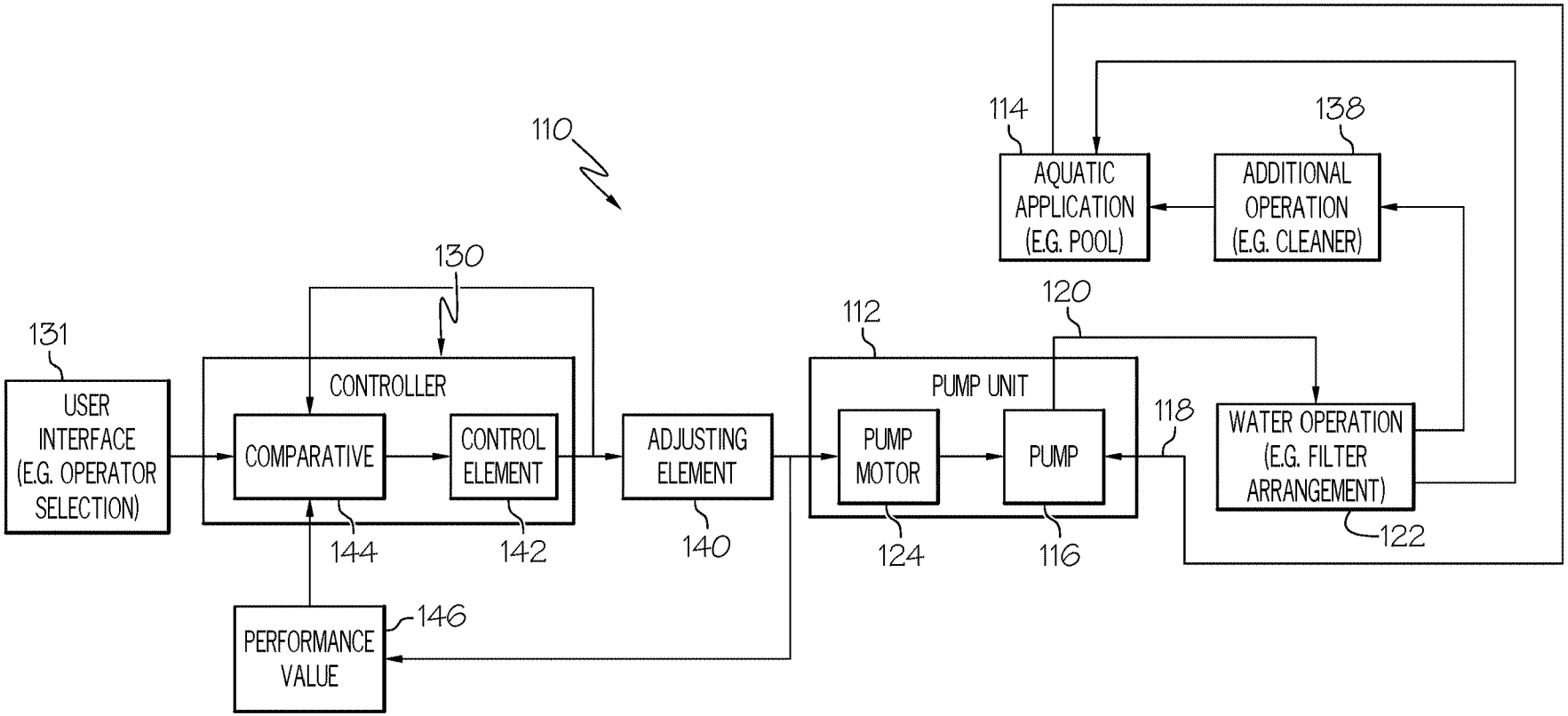
FIG. 2 is another block diagram of another example of a variable speed pumping system in accordance with the present invention with a pool environment.

The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such additional water movement may be used to supplant the need for other water movement.

Within another example (FIG. 2) of a pumping system 110 that includes means for sensing, determining, or the like one or more parameters indicative of the operation performed upon the water, the controller 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1. In addition, as stated above, the controller 130 can receive input from a user interface 131 that can be operatively connected to the controller in various manners.

Turning back to the example of FIG. 2, some examples of the pumping system 110, and specifically the controller 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter or performance value is power consumption. Pressure and/or flow rate can be calculated/determined from such pump parameter(s).

Although the system 110 and the controller 130 may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 operates in response to a comparative function 144, which receives input from a performance value 146.

The performance value 146 can be determined utilizing information from the operation of the pump motor 124 and controlled by the adjusting element 140. As such, a feedback iteration can be performed to control the pump motor 124. Also, operation of the pump motor and the pump can provide the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, graph or curve, such as a constant flow curve or the like, etc.) information can be utilized to determine various performance characteristics of the pumping system 110, such as input power consumed, motor speed, flow rate and/or the flow pressure. Thus, the controller (e.g., 30 or 130) provides the control to operate the pump motor/pump accordingly. In one example, the operation can be configured to prevent damage to a user or to the pumping system 10, 110 caused by a dry run condition. In other words, the controller (e.g., 30 or 130) can repeatedly monitor one or more performance value(s) 146 of the pumping system 10,110, such as the input power consumed by, or the speed of, the pump motor (e.g., 24 or 124) to sense or determine an unprimed status of the pumping system 10, 110.

Figure 3A:
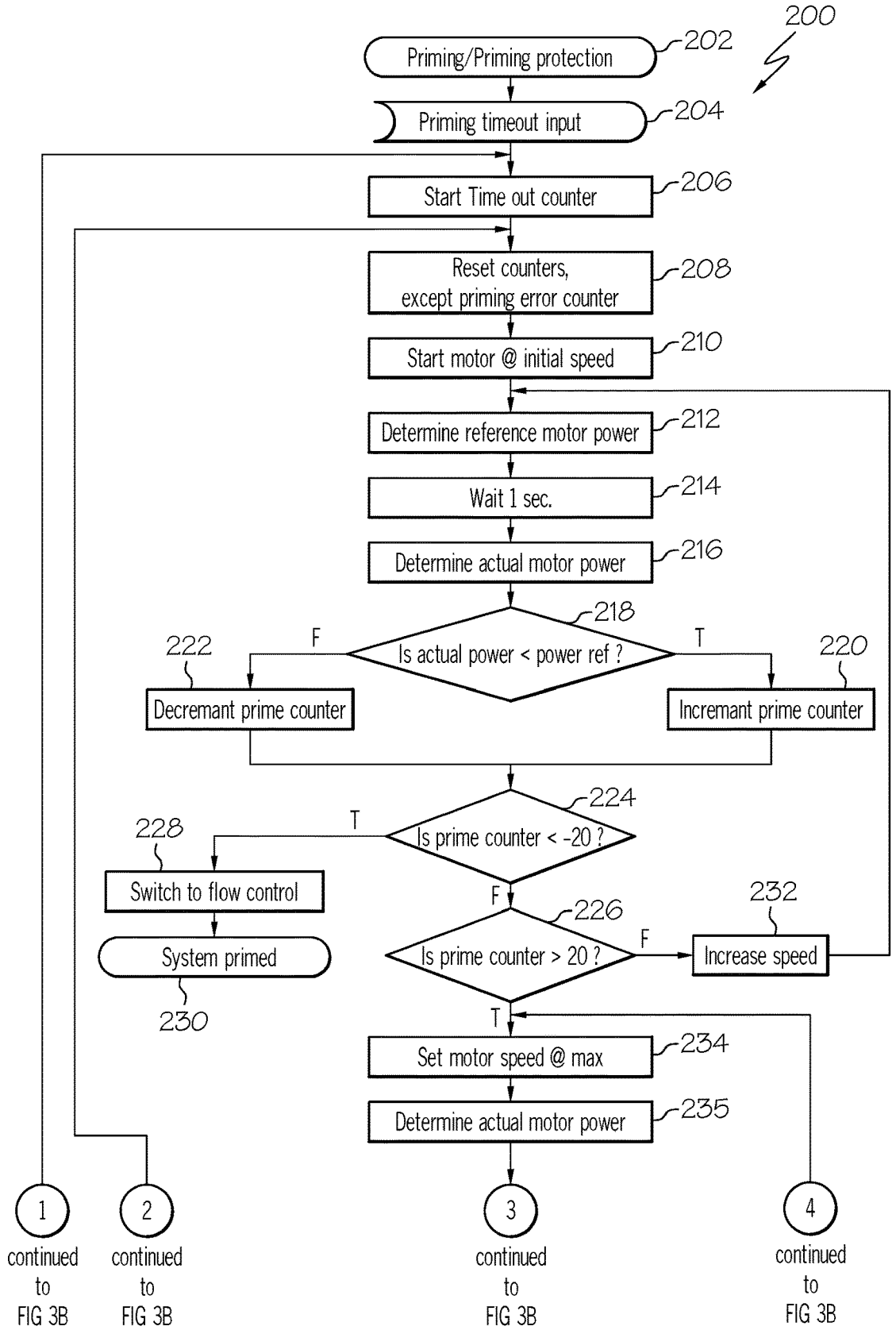
FIGS. 3A and 3B are a flow chart of an example of a process in accordance with an aspect of the present invention.
Figure 3B:
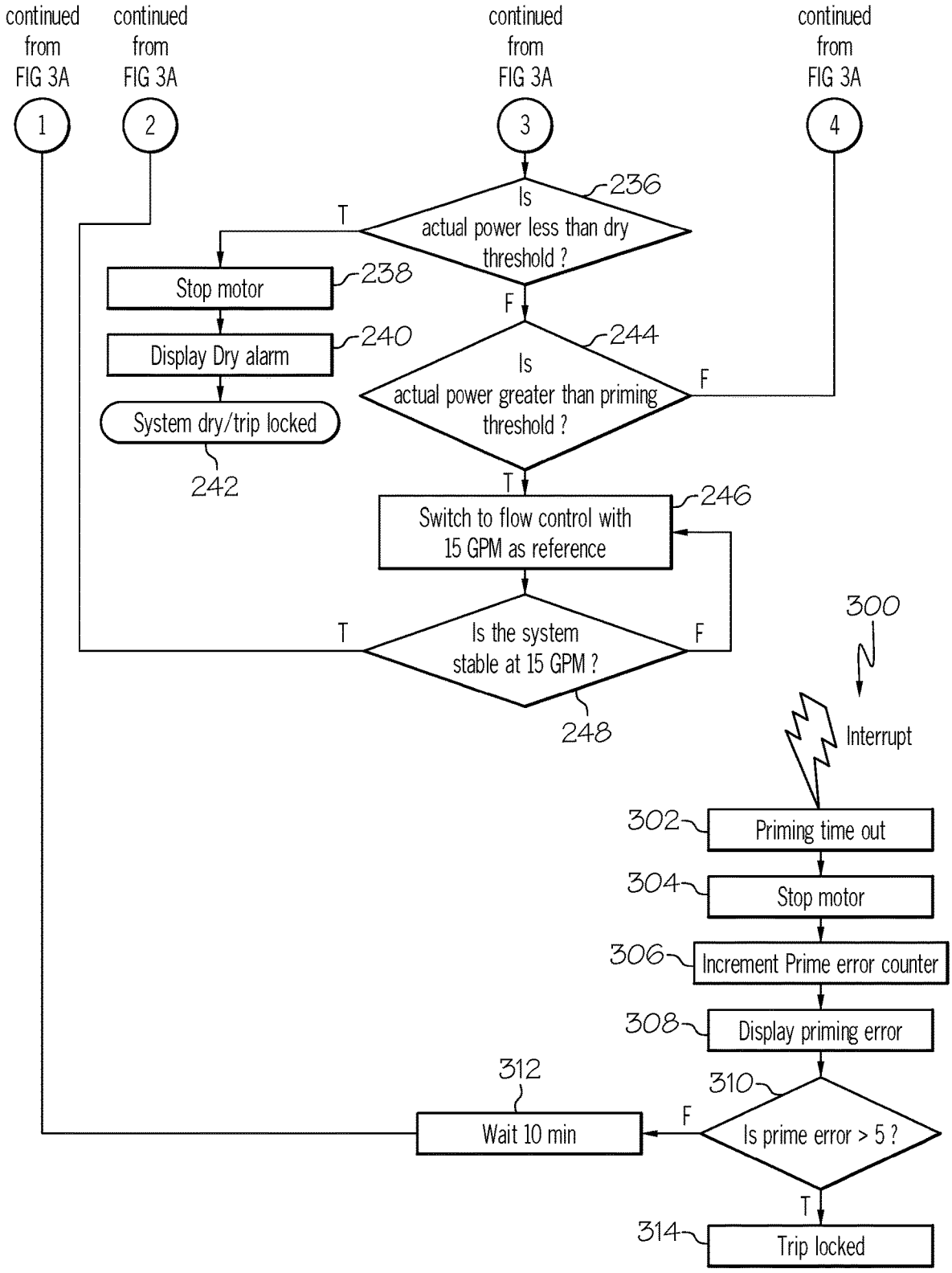

Turning to one specific example, attention is directed to the process chart that is shown in FIGS. 3A and 3B. It is to be appreciated that the process chart as shown is intended to be only one example method of operation, and that more or less steps can be included in various orders. Additionally, the example process can be used during startup of the pump 12, 112 to ensure a primed condition, and/or it can also be used to later ensure that an operating pump 12, 112 is maintaining a primed condition. For the sake of clarity, the example process described below can determine a priming status of the pumping system based upon power consumption of the pump unit 12, 112 and/or the pump motor 24, 124, though it is to be appreciated that various other performance values (i.e., motor speed, flow rate and/or flow pressure of water moved by the pump unit 12, 112, or the like) can also be used for a determination of priming status (e.g., though either direct or indirect measurement and/or determination). In one example, an actual power consumption of the motor 24, 124 can be compared against a reference (e.g., expected) power consumption of the motor 24, 124. When the priming status is in an unprimed condition, the motor 24, 124 will generally consume less power than the reference power consumption. Conversely, when the priming status is in a primed condition, the motor 24, 124 will generally consume an equal or greater amount of power as compared to the reference power consumption.

In another example, when the priming status is in an unprimed condition or the pumping system 10, 110 loses prime, the power consumed by the pump unit 12, 112 and/or pump motor 24, 124 can decrease. Thus, an unprimed condition or loss of prime can be detected upon a determination of a decrease in power consumption and/or associated other performance values (e.g., relative amount of decrease, comparison of decreased values, time elapsed, number of consecutive decreases, etc.). Power consumption can be determined in various ways. In one example, the power consumption can be based upon a measurement of electrical current and electrical voltage provided to the motor 24, 124. Various other factors can also be included, such as the power factor, resistance, and/or friction of the motor 24, 124 components, and/or even physical properties of the aquatic application, such as the temperature of the water.

In yet another example, the priming status can be determined based upon a measurement of water flow rate. For example, when an unprimed condition or loss of prime is present in the pumping system 10, 110, the flow rate of the water moved by the pump unit 12, 112 and/or pump motor 24, 124 can also decrease, and the unprimed condition can be determined from a detection of the decreased flow rate. In another example, the priming status can be determined based upon a comparison of determined reference and actual water flow rates.

As shown by FIGS. 3A and 3B, the process 200 can be contained within a constantly repeating loop, such as a "while" loop, "if-then" loop, or the like, as is well known in the art. In one example, the "while" or "if-then" loop can cycle at predetermined intervals, such as once every 100 milliseconds. Further, it is to be appreciated that the loop can include various methods of breaking out of the loop due to various conditions and/or user inputs. In one example, the loop could be broken (and the program stopped and/or restarted) if a user input value is changed. In another example, the loop could be broken if an interrupt command is issued. Interrupt signals, as are well known in the art, allow a processor (e.g., controller 30, 130) to process other work while an event is pending. For example, the process 200 can include a timer that is configured to interrupt the process 200 after a predetermined threshold time has been reached, though various other interrupt commands and/or processes are also contemplated to be within the scope of the invention. It is to be appreciated that the interrupt command can originate from the controller 30, 130, though it can also originate from various other processes, programs, and/or controllers, or the like.

The process 200 is initiated at step 202, which is merely a title block, and proceeds to step 204. At step 204, information can be retrieved from a filter menu, such as the user interface 31, 131. The information may take a variety of forms and may have a variety of contents. As one example, the information can include user inputs related a timeout value. Thus, a user can limit the amount of time the system can take to attempt to successfully prime. For example, a user can limit the process time to 5 minutes such that the process 200 stops the motor 24, 124 if the system remains in an unprimed status for a time exceeding the user input 5 minute timeout value, though various other times are also contemplated to be within the scope of the invention. In addition or alternatively, the information of step 204 can be calculated or otherwise determined (e.g., stored in memory or found in a look-up table, graph, curve or the like), and can include various forms, such as a value (e.g., "yes" or "no", a numerical value, or even a numerical value within a range of values), a percentage, or the like. It should be appreciated that such information (e.g., times, values, percentages, etc.) is desired and/or intended, and/or preselected/predetermined.

It is to be appreciated that even further information can be retrieved from a filter menu or the like (e.g., user interface 31, 131). In one example, the additional information can relate to an "auto restart" feature that can be adapted to permit the pumping system 10, 110 to automatically restart in the event that it has been slowed and/or shut down due to an unsuccessful priming condition. As before, the information can include various forms, such as a value (e.g., 0 or 1, or "yes" or "no"), though it can even comprise a physical switch or the like. It is to be appreciated that various other information can be input by a user to alter control of the priming protection system.

Subsequent to step 204, the process 200 can proceed onto step 206. At step 206, the process 200 can start/initialize the timeout timer. The timeout timer can include various types. In one example, the timeout timer can include a conventional timer that counts upwards or downwards in units of time (seconds, minutes, etc.). In another example, the timeout timer can include an electronic element, such as a capacitor or the like, that can increase or decrease an electrical charge over time.

Subsequent to step 206, the process 200 can proceed onto step 208. As can be appreciated, it can be beneficial to reset and/or initialize the various counters (e.g., timeout counter, retry counter, prime counter, etc.) of the process 200. For example, the timeout counter of step 206 can be reset and/or initialized. As can be appreciated, because the counters can include various types, each counter can be reset and/or initialized in various manners. For example, a clock-based timeout counter can be reset to a zero time index, while a capacitor-based timeout counter can be reset to a particular charge. However, it is to be appreciated that various counters may not be reset and/or initialized. For example, because the process 200 can be a repeating process within a "while" loop or the like, various counters may be required during various cycles of the program. For example, it can be beneficial not to reset the retry/prime-error counter between program loops to permit cumulative counting during process restarts.

Subsequent to step 208, the process can proceed onto step 210 to operate the motor 24, 124 at a motor speed. During a first program cycle, step 210 can operate the motor 24, 124 at an initial motor speed. However, during a subsequent program cycle, step 210 can operate the motor 24, 124 at various other motor speeds. The motor speed of the motor 24, 124 can be determined in various manners. In one example, the motor speed can be retrieved from a user input. In another example, the motor speed can be determined by the controller 30, 130 (e.g., calculated, retrieved from memory or a look-up table, graph, curve, etc). In yet another example, during subsequent program cycles, the motor speed can be increased or decreased from a previous program cycle.

Subsequent to step 210, the process 200 can determine a reference power consumption of the motor 24, 124 (e.g., watts or the like) based upon a performance value of the pumping system 10, 110. In one example, step 210 can determine a reference power consumption of the motor 24, 124 based upon the motor speed, such as by calculation or by values stored in memory or found in a look-up table, graph, curve or the like. In one example, the controller 30, 130 can contain a one or more predetermined pump curves or associated tables using various variables (e.g., flow, pressure, speed, power, etc.). The curves or tables can be arranged or converted in various manners, such as into constant flow curves or associated tables. For example, the curves can be arranged as a plurality of power (watts) versus speed (RPM) curves for discrete flow rates (e.g., flow curves for the range of 15 GPM to 130 GPM in 1 GPM increments) and stored in the computer program memory. Thus, for a given flow rate, one can use a known value, such as the motor speed to determine (e.g., calculate or look-up) the reference power consumption of the motor 24, 124. The pump curves can have the data arranged to fit various mathematical models, such as linear or polynomial equations, that can be used to determine the performance value.

Additionally, where the pump curves are based upon constant flow values, a reference flow rate for the pumping system 10, 110 should also be determined. The reference flow rate can be determined in various manners, such as by being retrieved from a program menu through the user interface 31, 131 or from other sources, such as another controller and/or program. In addition or alternatively, the reference flow rate can be calculated or otherwise determined (e.g., stored in memory or found in a look-up table, graph, curve or the like) by the controller 30, 130 based upon various other input values. For example, the reference flow rate can be calculated based upon the size of the swimming pool (i.e., volume), the number of turnovers per day required, and the time range that the pumping system 10, 110 is permitted to operate (e.g., a 15,000 gallon pool size at 1 turnover per day and 5 hours run time equates to 50 GPM). The reference flow rate may take a variety of forms and may have a variety of contents, such as a direct input of flow rate in gallons per minute (GPM).

Subsequent to step 212, the process 200 can proceed to step 214 to pause for a predetermined amount of time to permit the pumping system 10, 110 to stabilize from the motor speed change of step 210. As can be appreciated, power consumption of the motor 24, 124 can fluctuate during a motor speed change transition and/or settling time. Thus, as show, the process 200 can pause for 1 second to permit the power consumption of the motor 24 124 to stabilize, though various other time intervals are also contemplated to be within the scope of the invention.

Subsequent to step 214, the process can determine an actual power consumption of the motor 24, 124 when the motor is operating at the motor speed (e.g., from step 210). The actual power consumption can be measured directly or indirectly, as can be appreciated. For example, the motor controller can determine the present power consumption, such as by way of a sensor configured to measure, directly or indirectly, the electrical voltage and electrical current consumed by the motor 24, 124. Various other factors can also be included, such as the power factor, resistance, and/or friction of the motor 24, 124 components. In addition or alternatively, a change in actual power consumption over time (e.g., between various program cycles) can also be determined. It is to be appreciated that the motor controller can provide a direct value of present power consumption (i.e., watts), or it can provide it by way of an intermediary or the like. It is also to be appreciated that the present power consumption can also be determined in various other manners, such as by way of a sensor (not shown) separate and apart from the motor controller.

Subsequent to step 216, the process 200 can proceed onto step 218 to determine a determined value based upon a comparison of the reference power consumption and the actual power consumption. In one example, as shown, step 218 can be in the form of an "if-then" comparison such that if the actual power consumption is less than or greater than the reference power consumption, step 218 can output a true or false parameter, respectively. As stated previously, it is to be appreciated that when the priming status is in an unprimed condition, the motor 24, 124 will generally consume less power than the reference power consumption, and conversely, when the priming status is in a primed condition, the motor 24, 124 will generally consume an equal or greater amount of power as compared to the reference power consumption. Thus, as shown, if the actual power consumption is less than the reference power consumption (e.g., TRUE), the process 200 can proceed onto step 220 to increment (e.g., increase) a prime counter. For example, the prime counter can be increased by +1. Alternatively, if the actual power consumption is greater than the reference power consumption (e.g., FALSE), the process 200 can proceed onto step 222 to decrement (e.g., decrease) the prime counter (e.g., −1). Thus, it is to be appreciated that the determined value can include the prime counter, though it can also include various other values based upon other comparisons of the reference power consumption and the actual power consumption of the motor 24, 124. In addition or alternatively, in step 318, the actual power consumption can be compared against a previous actual power consumption of a previous program or time cycle (i.e., the power consumption determination made during the preceding program or time cycle) for a determination of a change in power consumption.

Subsequent to steps 220 and 222, the process 200 can proceed onto steps 224 and/or 226 to determine a priming status of the pumping system based upon the determined value (e.g., the prime counter). In steps 224 and 226, the process can determine the priming status based upon whether the prime counter exceeds one or more predetermine thresholds. For example, in step 224, the process 200 can determine whether the prime counter is less than −20. If the prime counter is less than −20 (e.g., TRUE), then the process 200 can be considered to be in a primed condition (e.g., see title block 230) and proceed onto step 228 to control the pumping system 10, 110 via a flow control scheme. That is, once the priming status is determined to be in a primed condition, control of the motor can be altered to adjust a flow rate of water moved by the pump unit 12, 112 towards a constant value (e.g., 15 GPM or other flow rate value). Additionally, once the system is determined to be in a primed condition, the process 200 can end until the pump is in need of further priming and/or a recheck of the priming status.

Alternatively, if the prime counter is not less than −20 (e.g., FALSE), then the process 200 can proceed onto step 226. In step 226, the process 200 can determine whether the prime counter is greater than +20. If the prime counter is not greater than +20 (e.g., FALSE), then the process 200 can be considered to be in a first unprimed condition and can proceed onto step 232 to increase the motor speed. In one example, the motor speed can be increased by 20 RPM, though various other speed increases can also be made. It is to be appreciated that various other changes in motor speed can also be performed, such as decreases in motor speed, and/or increasing/decreasing cycle fluctuations.

Additionally, after increasing the motor speed in step 232, the process can repeat steps 212-226 with the increased motor speed. That is, the process 200 can determine a new reference motor power consumption (step 212) based upon the new, increased motor speed, can determine the actual motor power consumption when the motor is operating at the increased motor speed (step 216), and can make the aforementioned comparison between the actual and reference power consumptions (step 218). The process 200 can then determine whether to increase or decrease the prime counter (steps 218-222), determine the prime status (steps 224-226), and alter control of the motor accordingly. It is to be appreciated that, because the prime counter can be reset at the beginning of the process 200, both of steps 224 and 226 should register as false conditions during at least the first nineteen cycle iterations (e.g., if the prime counter is reset to zero, and is increased or decreased by one during each cycle, it will take at least 20 program cycles for either of steps 224 or 226 for the prime counter to register +/−20). Thus, during the example general priming cycle process 200 shown herein, it is normal for both of steps 224 and 226 to output a false register during at least the first nineteen program cycle iterations.

Turning back to step 226, if the process 200 determines that the prime counter is greater than +20, (e.g., TRUE), then the priming status can be considered to be in a second unprimed condition, and the process 200 can proceed onto step 234. If the priming status is determined to be in the second unprimed condition, it can indicate that the pumping system 10, 110 is having difficulty achieving a primed condition for a variety of reasons. Accordingly, in step 234, the process 200 can increase the motor speed to the maximum motor speed in an attempt to draw in a greater volume of water into the pump 12, 112 to thereby reduce the amount of gas in the system.

However, in the event that the pumping system 10, 110 is having a difficult time priming because of excess gas in the system, running the motor at a maximum speed can create a dry run condition that can damage the pump 24, 124. As such, the process 200 can proceed onto steps 235 and 236 to provide a protection against a dry run condition. In step 235, the process 200 can determine the actual motor power consumption when the motor is operating at maximum speed using any of the various methodologies discussed herein.

Next, in step 236, the process 200 can determine whether the actual power consumption of the motor 24, 124 exceeds a dry run power consumption threshold. For example, in step 236, the process 200 can determine whether the actual motor power consumption is less than a dry run power consumption threshold. If the motor power consumption is less than the dry threshold (e.g., TRUE), then the process can proceed onto step 238 to stop operation of the motor 24, 124 to avoid a dry run condition can. In addition or alternatively, in step 240, the process 200 can also be configured to provide a visual and/or audible indication of dry run condition. For example, the process 200 can display a text message such as "Alarm: Dry Run" on a display, such as an LCD display, or it can cause an alarm light, buzzer, or the like to be activated to alert a user to the dry run condition. In addition or alternatively, the process 200 can lock the system in step 242 to prevent the motor 24, 124 from further operation during the dry run condition. The system can be locked in various manners, such as for a predetermined amount of time or until a user manually unlocks the system.

However, if the pumping system 10, 110 is not in a dry run condition (e.g., step 236 is FALSE), then the process can proceed onto step 238. In step 238, the process 200 can determine whether the actual power consumption of the motor operating at maximum motor speed is greater than a predetermined threshold. For example, the process 200 can determine whether the actual power consumption is greater than a priming power threshold when the motor is operating at maximum speed. If the actual power consumption is less than the priming power threshold (e.g., FALSE), then, because the system remains in an unprimed condition, the process 200 can repeat steps 234-244 to operate the motor at the maximum speed to thereby encourage a greater volume of water to move through the pump 12, 112 to reduce gas in the system. The process 200 can continue to repeat steps 234-244 until the timeout interrupt condition occurs, or until the system eventually becomes primed.

However, in step 244, if the actual power consumption is greater than the priming power threshold (e.g., TRUE, operation of the motor at a maximum speed has encouraged the priming status towards a primed condition), the process can proceed onto step 246. In step 246, the process 200 can control the pumping system 10, 110 via a flow control scheme. That is, the process 200 can alter control the motor 24, 124 to adjust a flow rate of water moved by the pump unit 12, 112 towards a constant value (e.g., 15 GPM or other flow rate value). Next, the process 200 can determine whether the pumping system 10, 110 is stable at the constant flow rate (e.g., 15 GPM) to ensure a generally constant actual power consumption of the motor, and to avoid a transient and/or settling response by the motor. If the system is determined not to be stable at the constant flow rate, the process 200 can repeat steps 246-248 until the system becomes stable, or until the timeout interrupt condition occurs. It is to be appreciated that various methods can be used to determine whether the system is stable. For example, the process 200 can determine that the system is stable by monitoring the actual power consumption of the motor over time and/or the flow rate or flow pressure of the water to ensure that the system is not in a transition and/or settling phase.

Keeping with step 248, if the process determines that the system is stable, the process can proceed back to step 208 to repeat the priming process to thereby ensure that the system is in fact primed. Thus, the process 200 can repeat steps 208-248 until the priming status achieves a primed condition, or until the timeout interrupt condition occurs, whichever is first.

Keeping with FIG. 3B, the process 200 can also include a timeout interrupt routine 300. The timeout interrupt routine 300 can act to protect the pump 12, 112 from damage in the event that the priming status remains in an unprimed condition for an amount of time that exceeds a predetermined amount of time. As stated previously, the timeout interrupt routine 300 operates as an interrupt, as is known in the art, which can break the process 200 loop if an interrupt command is issued. It is to be appreciated that the priming timeout routine 300 described herein is merely one example of an interrupt routine, and that various other interrupt routines can also be used.

The timeout interrupt routine 300 can operate in various manners to trigger a priming timeout interrupt command of step 302. In one example, the process 200 can include a timer (e.g., digital or analog) that is initialized and begins counting upwards or downwards in units of time (seconds, minutes, etc.) as previously discussed in steps 206-208. Thus, if the time counted by the timer exceeds a threshold time (e.g., the timeout input determined in step 204), and the priming status remains in an unprimed condition, the timeout interrupt routine 300 will trigger the interrupt command in step 302. However, it is to be appreciated that the timer can various other mechanical and/or electronic elements, such as a capacitor or the like, that can increase and/or decrease an electrical charge over time to provide a timing function.

Subsequent to the interrupt trigger of step 302, the timeout interrupt routine 300 can proceed onto step 304 to alter operation of the motor 24, 124, such as by stopping the motor. Thus, the timeout interrupt routine 300 can act to protect the motor 24, 124 by inhibiting it from continuously operating the pump 12, 112 in an unprimed condition. Following step 304, the timeout interrupt routine 300 can increment a prime error counter in step 306. The prime error counter can enable the timeout interrupt routine 300 to keep track of the number of failed priming attempts.

In addition or alternatively, in step 308, the timeout interrupt routine 300 can also be configured to provide a visual and/or audible indication of a priming error. For example, the process 200 can display a text message such as "Alarm: Priming Error" on a display, such as an LCD display, or it can cause an alarm light, buzzer, or the like to be activated to alert a user to the priming error.

Next, in step 310, the timeout interrupt routine 300 can determine whether the prime error counter of step 306 exceeds a prime error threshold. For example, as shown, if the timeout interrupt routine 300 determines that the prime error counter is less than five (e.g., FALSE), the routine 300 can proceed onto step 312. In step 312, the routine 300 can cause the priming process 200 to pause for a predetermined amount of time, such as ten minutes, to provide a settling period for the various components of the pumping system 10, 110. Following step 312, the timeout interrupt routine 300 can permit the priming process 200 to restart with step 206, wherein the timeout counter is re-initialized and the process 200 restarted. It is to be appreciated that various other prime error thresholds (e.g., step 310) and various other pause times (e.g., step 312) are also contemplated to be within the scope of the invention, and that the prime error thresholds and/or pause times can be retrieved from memory or input by a user.

Alternatively, if the timeout interrupt routine 300 determines that the prime error counter is greater than five (e.g., TRUE), then the routine 300 can proceed onto step 314 to lock the system. For example, if the routine 300 determines that the prime error counter is greater than the prime error threshold, it can indicate that the process 200 is having continued difficulty priming the pumping system 10, 110 without user intervention. Thus, locking the system can inhibit the motor 24, 124 from further operation in an unprimed condition after several unsuccessful attempts. The system can be locked in various manners, such as for a predetermined amount of time or until a user manually unlocks the system. The lockout step 314 can inhibit and/or prevent the pump unit 12, 112 and/or the motor 24, 124 from restarting until a user takes specific action. For example, the user can be required to manually restart the pump unit 12, 112 and/or the motor 24, 124 via the user-interface 31, 131, or to take other actions.

Additionally, it is to be appreciated that, for the various counters utilized herein, the process 200 and/or routine 300 can be configured to count a discrete number of occurrences (e.g., 1, 2, 3), and/or can also be configured to monitor and/or react to non-discrete trends in data. For example, instead of counting a discrete number of occurrences of an event, the process 200 and/or means for counting could be configured to monitor an increasing or decreasing performance value and to react when the performance value exceeds a particular threshold. In addition or alternatively, the process 200 and/or routine 300 can be configured to monitor and/or react to various changes in a performance value with respect to another value, such as time, another performance value, priming status, or the like.

Further still, the various comparisons discussed herein (e.g., at least steps 218, 224, 226, 236, 244, 248, 310) can also include various other "if-then" statements, sub-statements, conditions, comparisons, or the like. For example, multiple "if-then" sub-statements must be true in order for the entire "if-then" statement/comparison to be true. The various other sub-statements or comparisons can be related to various other parameters that can be indicative of priming status. For example, the sub-statements can include a comparison of changes to various other performance values, such as other aspects of power, motor speed, flow rate, and/or flow pressure. Various numbers and types of sub-statements can be used depending upon the particular system. Further still, process 200 and/or the routine 300 can be configured to interact with (i.e., send or receive information to or from) another means for controlling the pump 12, 112, such as a separate controller, a manual control system, and/or even a separate program running within the first controller 30, 130. The second means for controlling the pump 12, 112 can provide information for the various sub-statements as described above. For example, the information provided can include motor speed, power consumption, flow rate or flow pressure, or any changes therein, or even any changes in additional features cycles of the pumping system 10, 110 or the like.

In addition to the methodologies discussed above, the present invention can also include the various components configured to determine the priming status of the pumping system 10, 110 for moving water of an aquatic application. For example, the components can include the water pump 12, 112 for moving water in connection with performance of an operation upon the water and the variable speed motor 24, 124 operatively connected to drive the pump 12, 112. The pumping system 10, 110 can further include means for determining a reference power consumption of the motor 24, 124 based upon a performance value of the pumping system 10, 110, means for determining an actual power consumption of the motor 24, 124, and means for comparing the reference power consumption and the actual power consumption. The pumping system 10, 110 can further include means for determining a priming status of the pumping system 10, 110 based upon the comparison of the reference power consumption and the actual power consumption. The priming status can include at least one of the group of a primed condition and an unprimed condition. In addition or alternatively, the pumping system 10, 110 can include means for operating the motor 24, 124 at a motor speed and/or means for altering control of the motor 24, 124 based upon the priming status. It is to be appreciated that the pumping system 10, 10 discussed herein can also include any of the various other elements and/or methodologies discussed previously herein.

It is also to be appreciated that the controller (e.g., 30 or 130) may have various forms to accomplish the desired functions. In one example, the controller 30 can include a computer processor that operates a program. In the alternative, the program may be considered to be an algorithm. The program may be in the form of macros. Further, the program may be changeable, and the controller 30, 130 is thus programmable.

Figure 4:
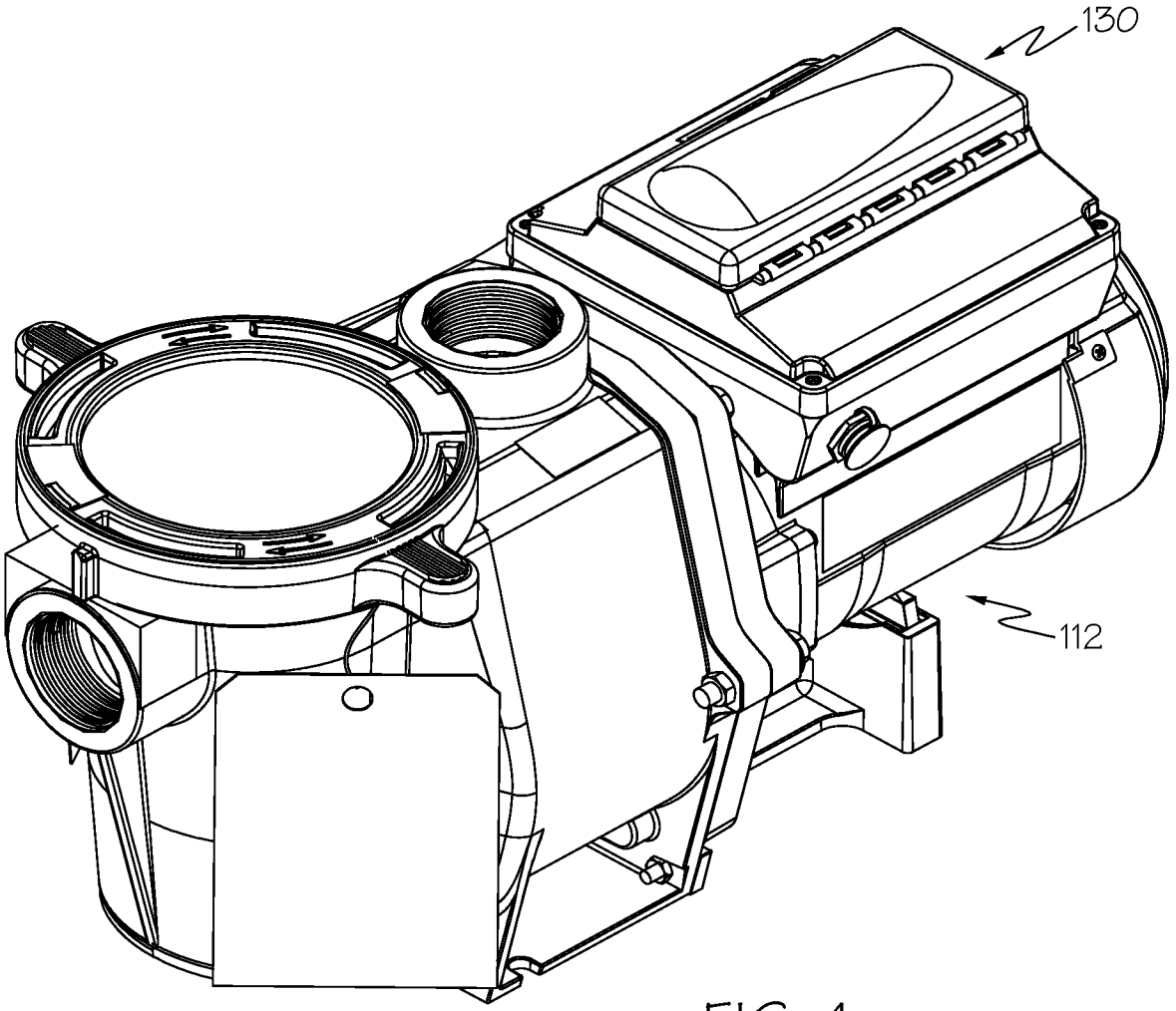
FIG. 4 is a perceptive view of an example pump unit that incorporates the present invention.
Figure 5:
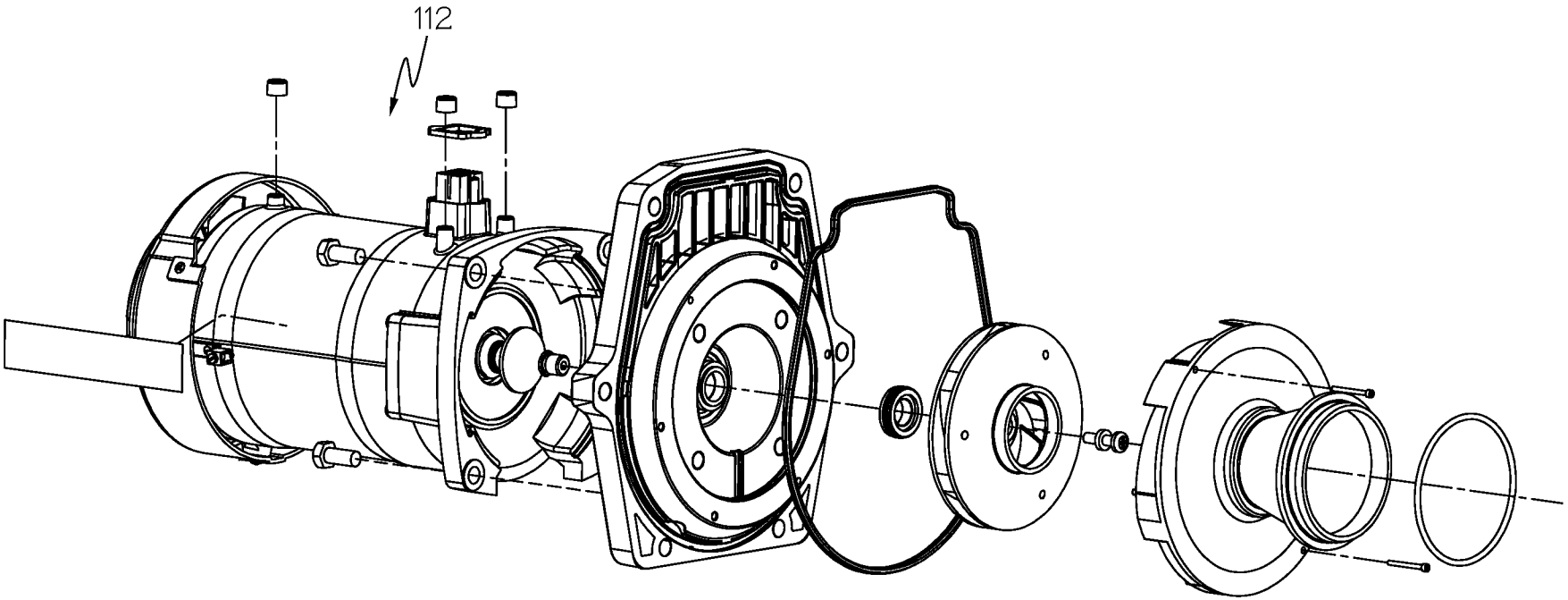
FIG. 5 is a perspective, partially exploded view of a pump of the unit shown in FIG. 4.
Figure 6:
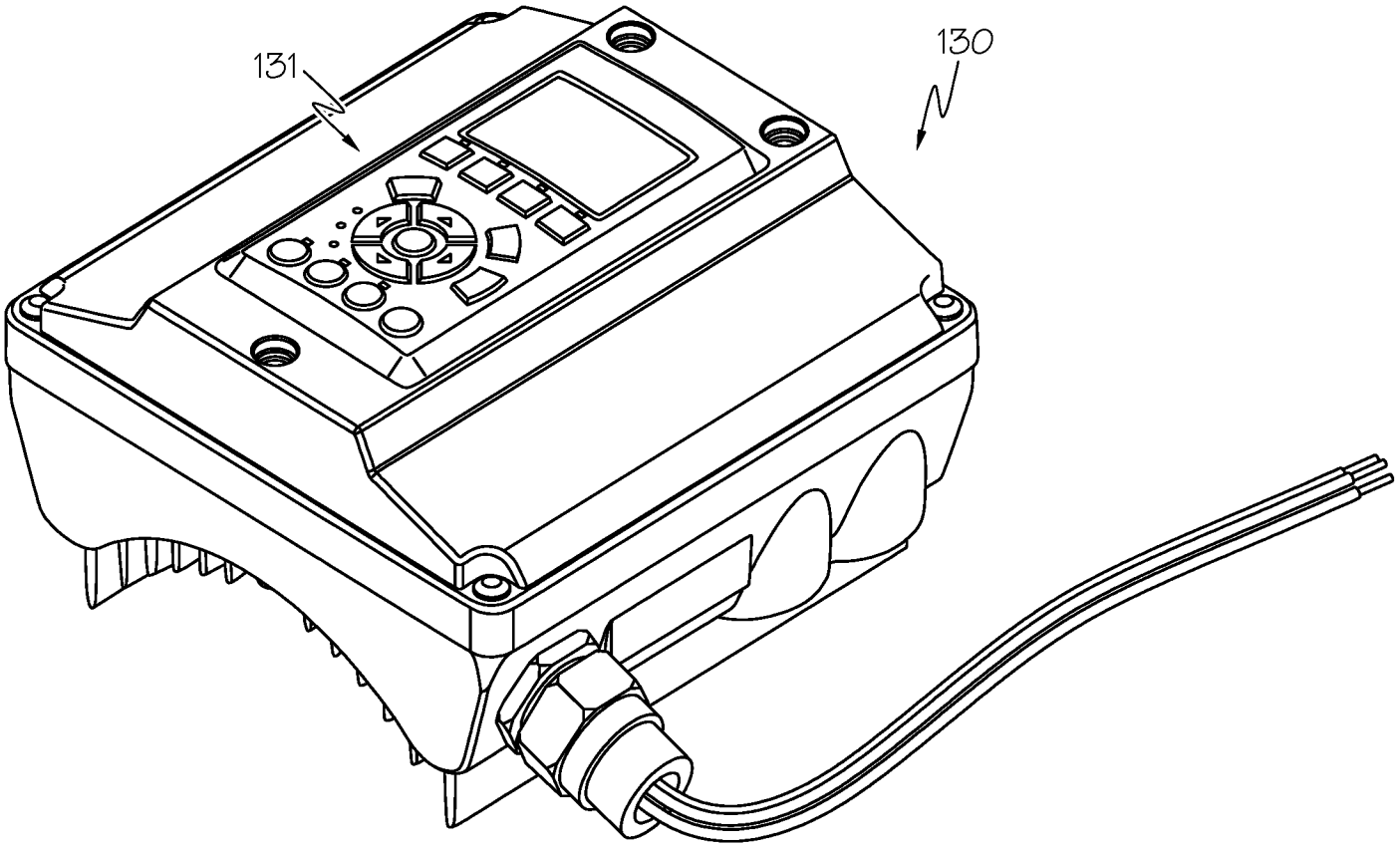
FIG. 6 is a perspective view of a control unit of the pump unit shown in FIG. 4.

Also, it is to be appreciated that the physical appearance of the components of the system (e.g., 10 or 110) may vary. As some examples of the components, attention is directed to FIGS. 4-6. FIG. 4 is a perspective view of the pump unit 112 and the controller 130 for the system 110 shown in FIG. 2. FIG. 5 is an exploded perspective view of some of the components of the pump unit 112. FIG. 6 is a perspective view of the controller 130 and/or user interface 131.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

The invention claimed is:

1. A pumping system for at least one aquatic application, the pumping system comprising:

a pump;

a motor coupled to the pump; and a controller in communication with the motor, the controller configured to store a timeout time value, the controller configured to initiate a pump priming process and subsequently initiate a timeout counter to begin counting a counter time value, the controller configured to initiate a timeout interrupt routine that interrupts the pump priming process when the counter time value exceeds the timeout time value, the timeout interrupt routine comprises shutting down the motor, and the controller configured to increment a prime error counter value after shutting down the motor during the timeout interrupt routine.

2. The pumping system of claim 1, wherein the timeout time value is a user input value.

3. The pumping system of claim 1, wherein the timeout time value is stored in a look-up table in a memory of the controller.

4. The pumping system of claim 1, wherein the counter time value is reset to zero when the pump has been successfully primed.

5. The pumping system of claim 1, wherein the controller is configured to display a priming error after shutting down the motor during the timeout interrupt routine.

6. The pumping system of claim 1, wherein the controller is configured to store a prime error value.

7. The pumping system of claim 6, wherein the controller is configured to lock out the pumping system when the prime error counter value exceeds the prime error value.

8. The pumping system of claim 6, wherein the controller initiates a predetermined time delay when the prime error counter value is equal to or below the prime error value.

9. The pumping system of claim 6, wherein the prime error value is a user input value.

10. The pumping system of claim 7, wherein the controller is configured to prevent the pumping system from being initialized after the controller locks out the pumping system until a manual input is received by the controller.

11. The pumping system of claim 8, wherein the controller automatically restarts the pump priming process when the predetermined time delay has elapsed.

12. The pumping system of claim 8, wherein the predetermined time delay is a user input value.

13. A pumping system comprising:

a pump;

a motor coupled to the pump; and a controller in communication with the motor, the controller configured to store a timeout time value, the controller configured to store a dry run power consumption threshold value, the controller configured to receive an actual power consumption value of the motor, the controller configured to initiate a timeout counter to begin counting a counter time value, the controller configured to compare the actual power consumption value to a reference value indicative of a reference power value of the motor, the controller configured to prime and run the pump when the actual power consumption value is less than the reference value and to continue to do so until the actual power consumption value is equal to or greater than the reference value unless the counter time value exceeds the timeout time value, and wherein the controller is configured to lock out the pumping system when the actual power consumption value is less than the dry run power consumption threshold value.

14. The pumping system of claim 13, wherein the controller is configured to initiate the timeout counter prior to priming and running the pump.

15. The pumping system of claim 13, wherein the controller is configured to initiate a timeout interrupt routine when the counter time value exceeds the timeout time value.

16. The pumping system of claim 13, wherein the controller is configured to stop the motor when one of the actual power consumption value is less than the dry run power consumption threshold value or the counter time value exceeds the timeout time value.

17. The pumping system of claim 13, wherein the controller is configured to display a dry run alarm when the actual power consumption value is less than the dry run power consumption threshold value.

* * * * *